US006607343B1

(12) United States Patent
Amgar

(10) Patent No.: US 6,607,343 B1
(45) Date of Patent: Aug. 19, 2003

(54) TWO-LEVEL PARKING SYSTEM

(75) Inventor: Avraham Amgar, Holon (IL)

(73) Assignee: D.G.A. Products Development Ltd. (IL)

( * ) Notice: Subject to any disclaimer, the term of this patent is extended or adjusted under 35 U.S.C. 154(b) by 0 days.

(21) Appl. No.: 09/744,216

(22) PCT Filed: Jul. 21, 1999

(86) PCT No.: PCT/IL99/00402

§ 371 (c)(1),
(2), (4) Date: Mar. 19, 2001

(87) PCT Pub. No.: WO00/05465

PCT Pub. Date: Feb. 3, 2000

(30) Foreign Application Priority Data

| | | |
|---|---|---|
| Jul. 23, 1998 | (IL) | 125470 |
| Nov. 22, 1998 | (IL) | 127185 |
| Jan. 21, 1999 | (IL) | 128179 |

(51) Int. Cl.[7] ..... E04H 6/06
(52) U.S. Cl. ..... 414/228; 414/233; 414/240
(58) Field of Search ..... 414/233, 228, 414/240

(56) References Cited

U.S. PATENT DOCUMENTS

| | | | |
|---|---|---|---|
| 2,639,046 | A | 5/1953 | Tatosian |
| 3,941,257 | A | 3/1976 | Matsuura |
| 4,029,218 | A | 6/1977 | Matsuura |
| 5,158,413 | A | 10/1992 | Wu |
| 5,593,266 | A | 1/1997 | Wurzinger |
| 5,839,871 | A | 11/1998 | Namgung |

FOREIGN PATENT DOCUMENTS

| | | | |
|---|---|---|---|
| BE | 844923 | | 10/1976 |
| EP | 0 340 673 | | 11/1989 |
| GB | 2243600 | | 11/1991 |
| JP | 2455537 | * | 5/1976 |
| JP | 4-73379 | | 3/1992 |
| JP | 4-102673 | | 4/1992 |
| JP | 6 81504 | * | 3/1994 |
| JP | 7269144 | * | 10/1995 |
| JP | 8209965 | * | 8/1996 |
| JP | 8218663 | * | 8/1996 |
| WO | WO 97/31169 | | 8/1997 |
| WO | WO 98/40586 | | 9/1998 |

* cited by examiner

*Primary Examiner*—Steven A. Bratlie
(74) *Attorney, Agent, or Firm*—Woodcock Washburn LLP

(57) ABSTRACT

A parking system (100) including a plurality of lever arms (103, 104, 114, 118, 122) serially and pivotally connected to each other from a nearest lever arm to a furthest lever arm, each lever arm being movable from a first orientation to a second orientation, wherein an angle of each lever arm relative to a ground surface is greater in the second orientation than in the first orientation, the nearest lever arm being connectable to a support structure (101) for supporting thereupon a vehicle to be parked, and drive apparatus (108) operatively connected to the lever arms (103, 104, 114, 118, 122) and operative to sequentially lift each of the lever arms (103, 104, 114, 118, 122), starting with the furthest lever arm and ending with the nearest lever arm, from its first orientation to its second orientation.

20 Claims, 28 Drawing Sheets

TWO-LEVEL PARKING SYSTEM

FIELD OF THE INVENTION

The present invention relates generally to vehicle parking systems for parking one vehicle on top of the parking place of another vehicle.

BACKGROUND OF THE INVENTION

Vehicle parking systems for parking one vehicle on top of the parking place of another vehicle are well known. Particularly relevant examples of such systems include the following U.S. Pat. No. 3,941,257 to Matsuura which describes multi-stage parking apparatus with vertically movable pallets which move on a fixed guide track; U.S. Pat. No. 5,158,413 to Wu which describes a car parking frame with upper and lower floors movable by a chain drive assembly; U.S. Pat. No. 5,593,266 to Wurzinger which describes a mechanical lifting mechanism on an arcuate track; and U.S. Pat. No. 5,839,871 to Namgung which describes a double-pallet parking garage in which the pallets are raised and lowered by means of turning links.

A disadvantage of prior art systems, including the above referenced art, is that the framework of the lift apparatus must be safely anchored so that the framework does not move or buckle during operation. This generally requires poured cement moorings or foundations. In addition, relatively powerful motors or hydraulic lift devices are generally required to lift the vehicle, thereby increasing the cost of building and operating the system.

SUMMARY OF THE INVENTION

The present invention seeks to provide an improved two-level parking system for parking one vehicle on top of another. Unlike the prior art, the system has a simple and inexpensive construction, yet safely supports a vehicle without any need for anchoring the system to a foundation. The system is characterized by a multiple-lever-arm design that permits lifting the vehicle with a relatively small motor instead of the robust, relatively powerful and expensive motors of the prior art.

The vehicle is lifted along an arcuate track, preferably by means of a chain drive. A pair of lever arms constantly contact the ground and support the vehicle during the initial lifting of the vehicle, and a normal from the center of gravity of the vehicle to the ground does not pass far from ground-contacting surfaces of the lever arms. Up until the point when the vehicle has been lifted onto a support frame, the majority of the vehicle weight is constantly supported by the lever arms, while the frame itself does not have to support much weight. Since the forces and overturning moments acting on the frame are relatively small and insignificant, the frame does not have to be anchored to the floor. The system is also distinguished by quiet, smooth and efficient operation.

There is thus provided in accordance with a preferred embodiment of the present invention a parking system including a plurality of lever arms serially and pivotally connected to each other from a nearest lever arm to a furthest lever arm, each lever arm being movable from a first orientation to a second orientation, wherein an angle of each lever arm relative to a ground surface is greater in the second orientation than in the first orientation, the nearest lever arm being connectable to a support structure for supporting thereupon a vehicle to be parked, and drive apparatus operatively connected to the lever arms and operative to sequentially lift each of the lever arms, starting with the furthest lever arm and ending with the nearest lever arm, from its first orientation to its second orientation.

In accordance with a preferred embodiment of the present invention one or more of the lever arms constantly contacts the ground surface before the drive apparatus lifts the next furthest lever arm from the first orientation to the second orientation.

Further in accordance with a preferred embodiment of the present invention the furthest ground-contacting lever arm of those lever arms which contact the ground surface is pivotably connected at a reference pivot to the nearest lever arm of those lever arms which have been lifted above the ground surface to the second orientation.

Still further in accordance with a preferred embodiment of the present invention there is also provided a support frame and a support structure for supporting thereupon a vehicle, the support structure being pivotally attached at a far end thereof to the nearest lever arm and at a near end thereof to the support frame, wherein the drive apparatus is connected to the near end of the support structure and is operative to move the near end of the support structure along the support frame.

Additionally in accordance with a preferred embodiment of the present invention a vehicle is supported on the support structure, and the drive apparatus lifts the lever arms such that the center of gravity of the vehicle is constantly positioned with respect to the reference pivot such that the total moment produced by the weight of the vehicle and the weight of the support structure on the far side of the reference pivot is not greater than the total moment produced by the weight of the support frame and the support structure acting on the near side of the reference pivot.

In accordance with a preferred embodiment of the present invention the drive apparatus includes a motor which drives a chain drive connected to the near end of the support structure.

Further in accordance with a preferred embodiment of the present invention the support frame includes generally arcuate support rails.

Still further in accordance with a preferred embodiment of the present invention the support frame includes support rails having a generally inverted U-shape with an elongate linear upper portion.

Additionally in accordance with a preferred embodiment of the present invention the chain drive is slidably supported on the support frame.

In accordance with a preferred embodiment of the present invention the support frame includes an anti-friction material underlying the chain drive.

Further in accordance with a preferred embodiment of the present invention the chain drive includes a bridging link pivotally connected to at least one of the lever arms.

Still further in accordance with a preferred embodiment of the present invention safety apparatus is provided which is responsive to slackening of the chain drive, and which locks the bridging link against the support frame.

Additionally in accordance with a preferred embodiment of the present invention the safety apparatus includes a normally retracted, spring-loaded stop member, and a series of protrusions provided on the support frame, so that upon a slackening of the chain drive, free fall of the support frame is prevented by the stop member becoming engaged by a nearby protrusion.

In accordance with a preferred embodiment of the present invention a turntable platform is rotatably mounted on the lever arms.

Further in accordance with a preferred embodiment of the present invention an actuator, operable by rotation of the turntable platform over the lever arms, actuates flaps provided at a vehicle access position on the turntable platform.

Still further in accordance with a preferred embodiment of the present invention a chain blocking member is provided for limiting travel of the chain drive.

Additionally in accordance with a preferred embodiment of the present invention a locking mechanism is provided for locking wheels of a vehicle parked on the ground surface.

In accordance with a preferred embodiment of the present invention the locking mechanism includes at least one platform arranged to move downwards when bearing a wheel of a vehicle thereupon, a pivotable wheel barrier pivoted at a lower end thereof about a pivot, a stop bar pivotally attached to the wheel barrier, adapted to abut against a stationary chock, the stop bar being supported by a pin connected to the at least one platform, wherein when the at least one platform is moved downwards, the stop bar pivots and abuts against the chock.

Further in accordance with a preferred embodiment of the present invention the locking mechanism also includes a linkage arm pivotally connected to the wheel barrier at one end thereof and to a biasing device at an opposite end thereof, a locking bar arranged to move against the linkage arm and to be received in a recess formed in the linkage arm, and a lock mounted at one end of the locking bar which selectively permits movement of the locking bar.

Additionally in accordance with a preferred embodiment of the present invention the locking mechanism also includes a sensor mounted in propinquity to the lever arms which senses and verifies an absence of a person within a predefined zone with respect to the lever arms.

BRIEF DESCRIPTION OF THE DRAWINGS

The present invention will be understood and appreciated more fully from the following detailed description, taken in conjunction with the drawings in which:

FIGS. 20–23 are simplified pictorial illustrations of a locking mechanism for locking the wheels of a vehicle parked on the ground level of the parking systems of the present invention, constructed and operative in accordance with a preferred embodiment of the present invention, wherein:

FIG. 20 illustrates the locking mechanism before entry thereinto of a vehicle;

FIG. 21 illustrates the locking mechanism after entry thereinto of a vehicle;

FIG. 22 illustrates a locking bar of the locking mechanism; and

FIG. 23 illustrates a simplified top view of the locking mechanism.

DETAILED DESCRIPTION OF A PREFERRED EMBODIMENT

Figure 1:
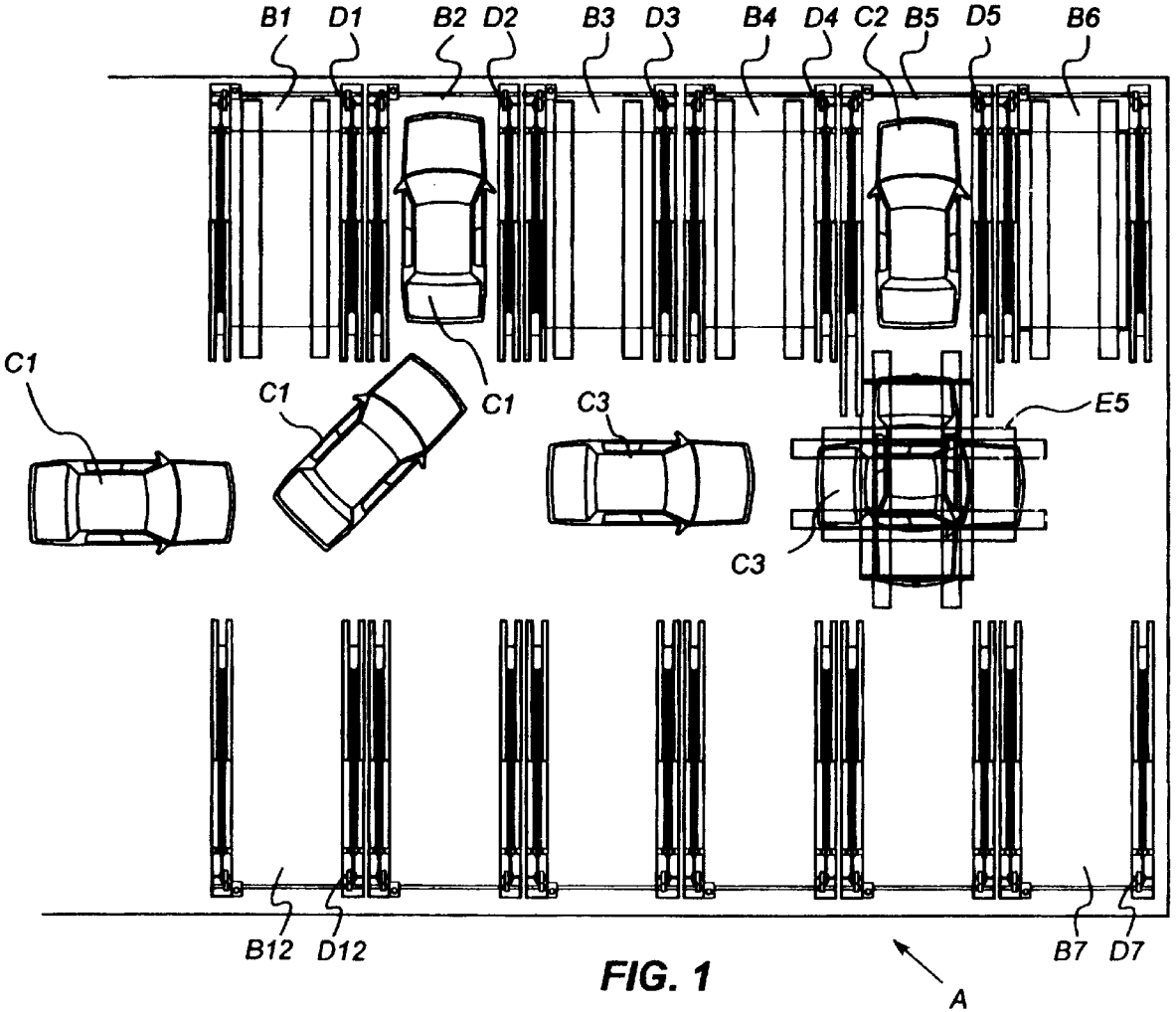
FIG. 1 is a general layout of a typical parking lot with two-storied parking systems constructed according to the present invention.

Reference is now made to FIG. 1 which illustrates a parking lot generally denoted A having, in the present example, twelve parking spaces B1, B2, B3, . . . B12. All parking places are equipped with parking lifting mechanisms D as will be described below (only partly and schematically shown for the sake of clarity).

As seen in FIG. 1, a motorcar designated C may be maneuvered into a ground-level parking place B2 (however, as will be understood from the description below, only after the respective lifting mechanism of the second story parking has been brought to its elevated position).

Figure 2:
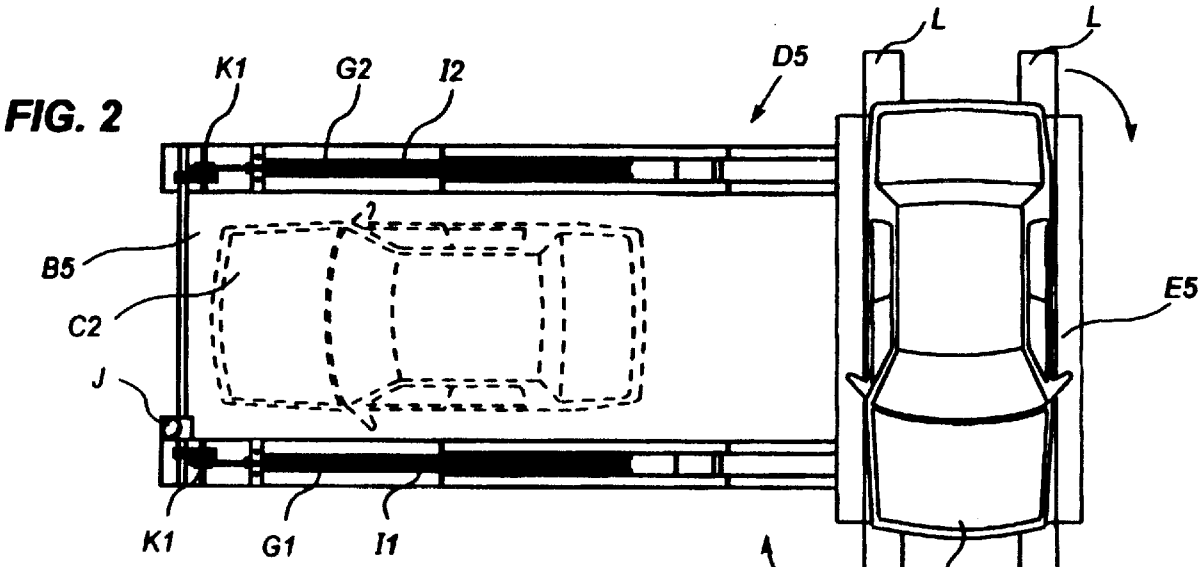
FIG. 2 is a simplified top view of a parking place with a parked motorcar over which a second car is about to be parked, at a first parking stage.
Figure 3:
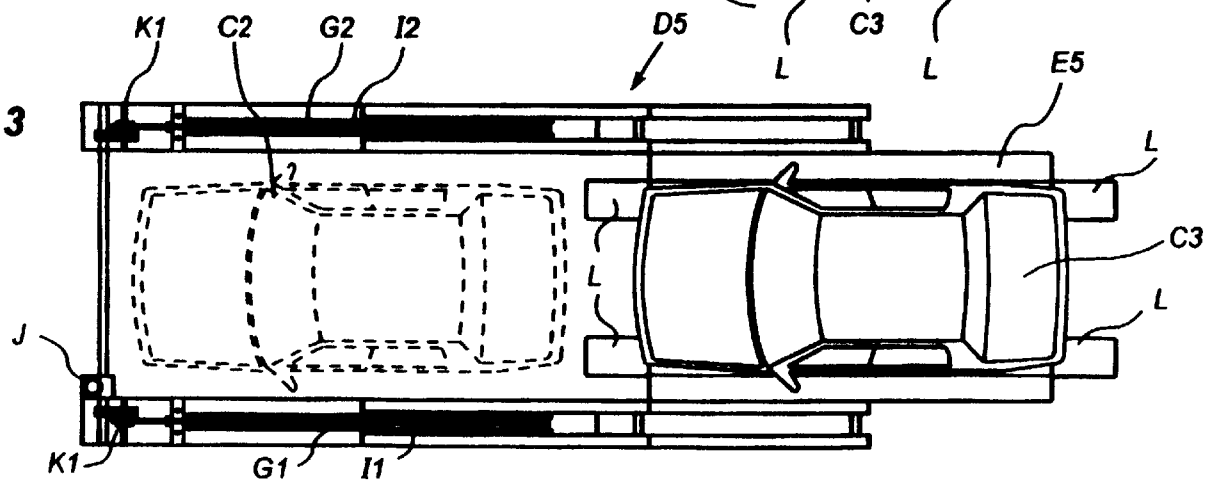
FIG. 3 illustrates a second parking stage.
Figure 4:
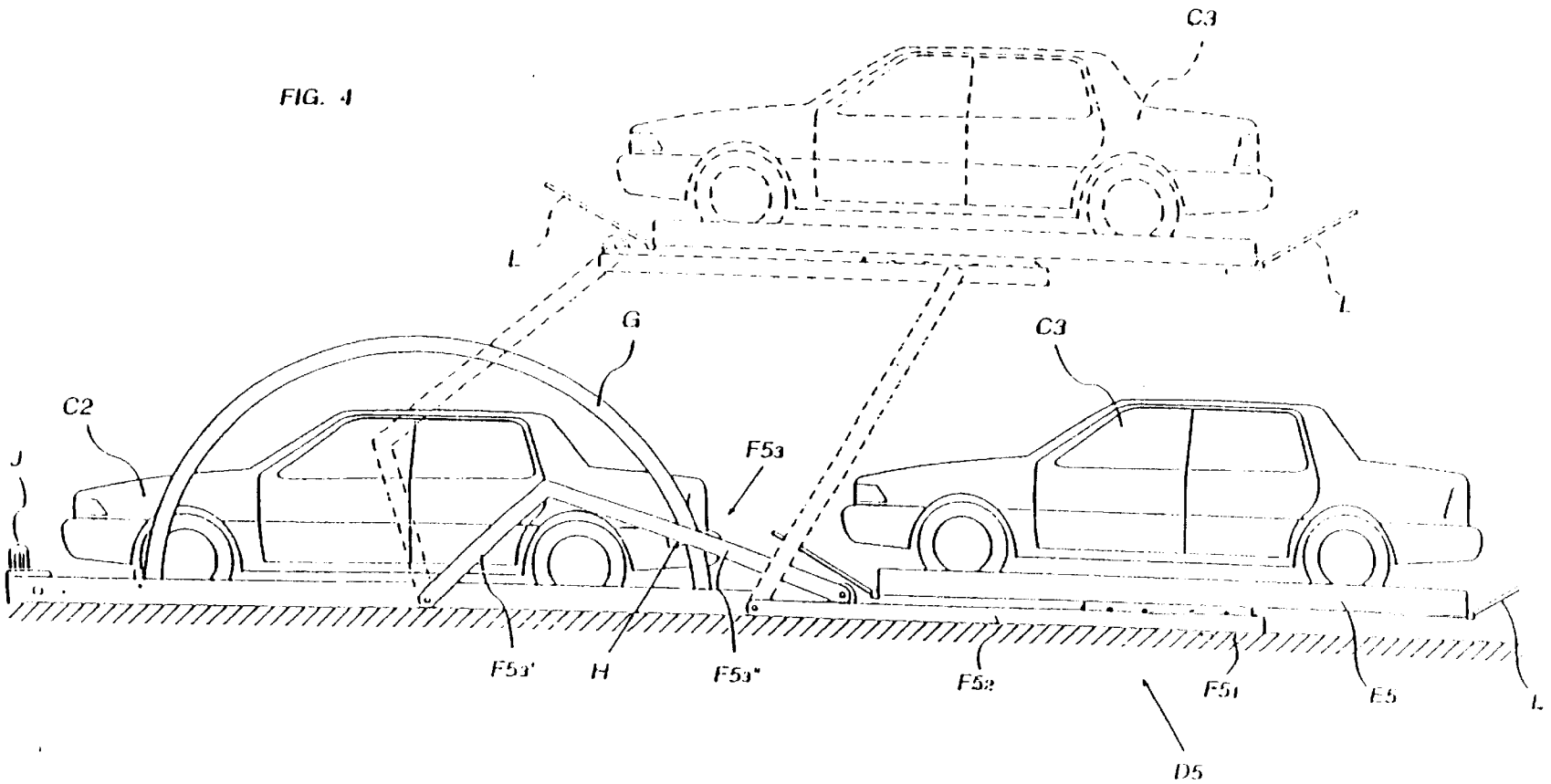
FIG. 4 is a side elevation of a third parking stage.

Another parking place B5 is already occupied by a car C2, and it is desired, for example, to lift another car C3 above car C2. The general procedure, which will be made much more clear furtherbelow, is such that the car C3 is first placed on a turntable revolving platform generally denoted E5 of lifting mechanism D5 (see FIG. 2); the platform is rotated by 90° (FIG. 3), and lifted along an arcuate path until positioned above car C2 (FIGS. 4 and 5).

Figure 5:
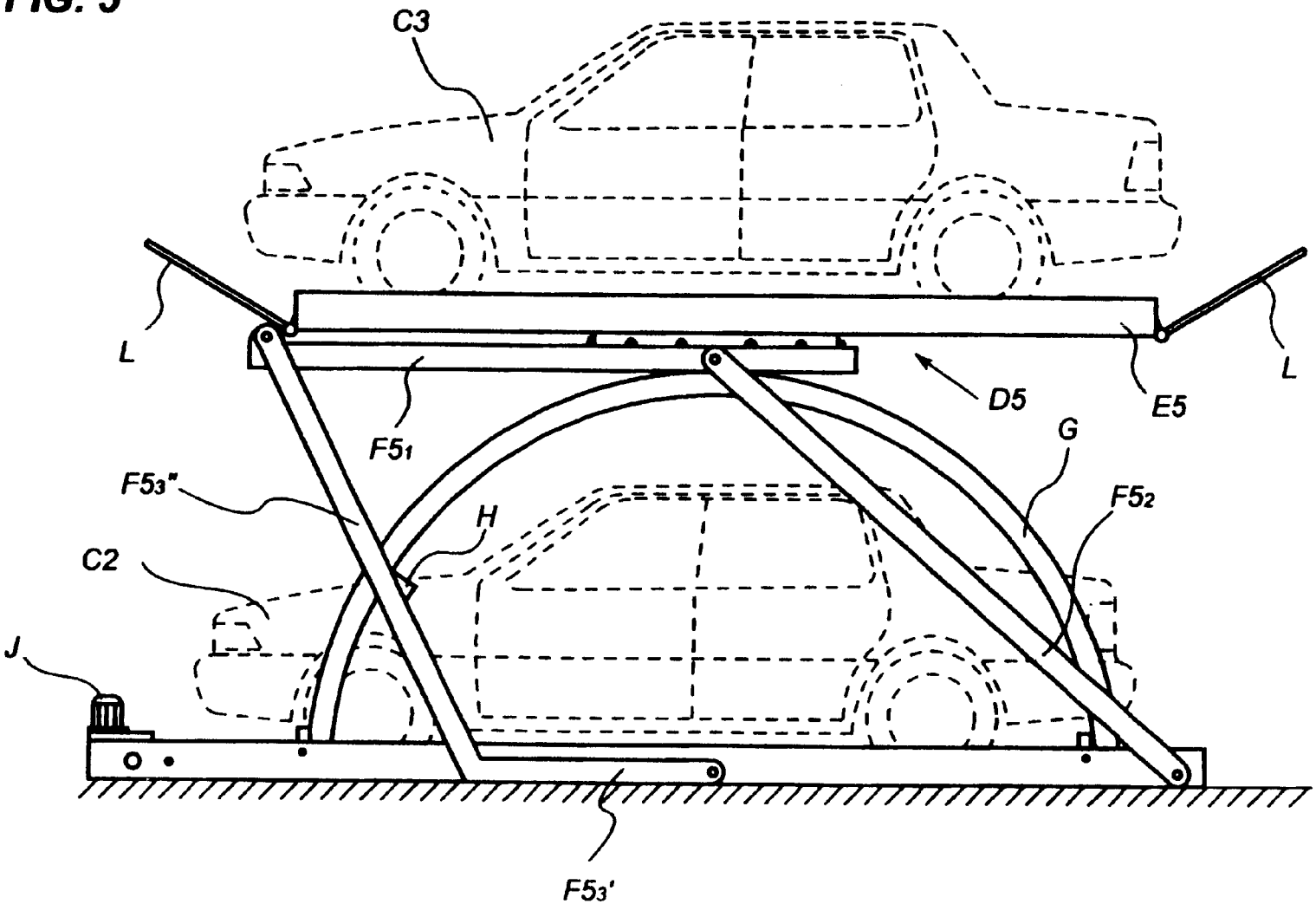
FIG. 5 shows a final parking position.

Lifting car C3 into the position of FIG. 5 is performed in the following manner. There is preferably provided a pair of parallelogram systems, generally denoted F5, comprising turntable support platform $F5_1$; first lever arm $F5_2$, and second lever arm $F5_3$ (at both sides of the system). Lever arms $F5_3$, are preferably generally L-shaped, having first section $F5_{3'}$ and second section $F5_{3''}$.

Figure 6:
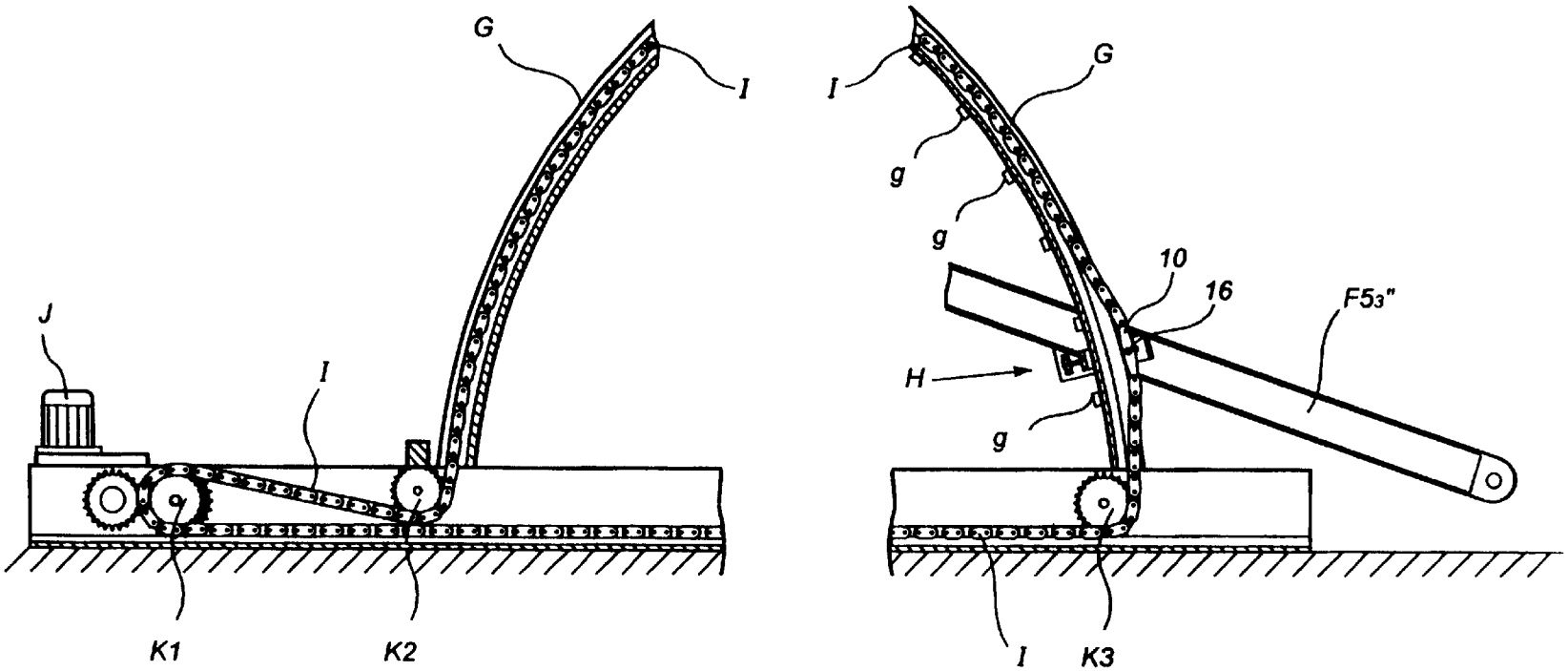
FIG. 6 shows on an enlarged scale details of construction of a parking system mechanism, constructed and operative in accordance with a preferred embodiment of the present invention.
Figure 7:
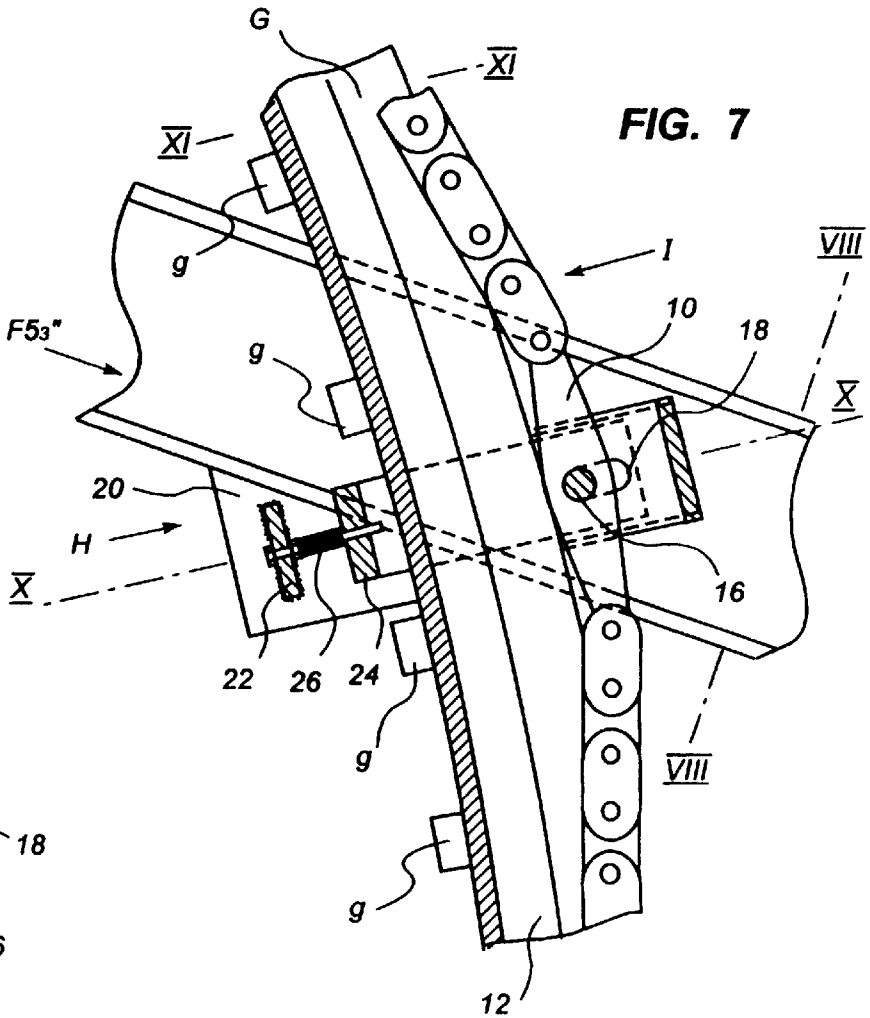
FIG. 7 is a cross-sectional view of a chain traction and safety mechanism.

The lever arms $F5_3$ are preferably coupled to chains I (see FIGS. 6 and 7), slung over arcuate supports G through a traction (and safety) device generally denoted H, details of which will be given with reference to FIGS. 7–10. The chain is driven by a motor J via suitable transmission arrangement, in one or the opposite direction.

When pulled by the traction device H, the platforms $F5_1$ and E5 are lifted, maintaining a generally horizontal position, until reaching the position shown in FIG. 5, namely, up to the second story parking place.

In that position, the lower parked car C2 may leave the parking place in the normal way, namely, in the opposite order of the maneuvering described above with respect to the motorcar C1 (see FIG. 1).

Particulars of the traction and safety device H will now be described with reference to FIGS. 6–10. Chain I is preferably a sprocket type chain, although it can be other types, and meshes with sprocket gear wheels K1, K2 and K3. A bridging link 10 preferably connects the two ends of the chain.

Figure 9:
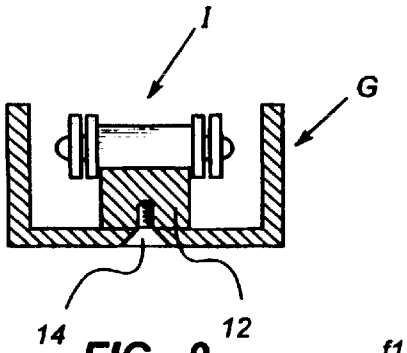
FIG. 9 is a cross-section taken along lines XI—XI of FIG. 7.
Figure 10:
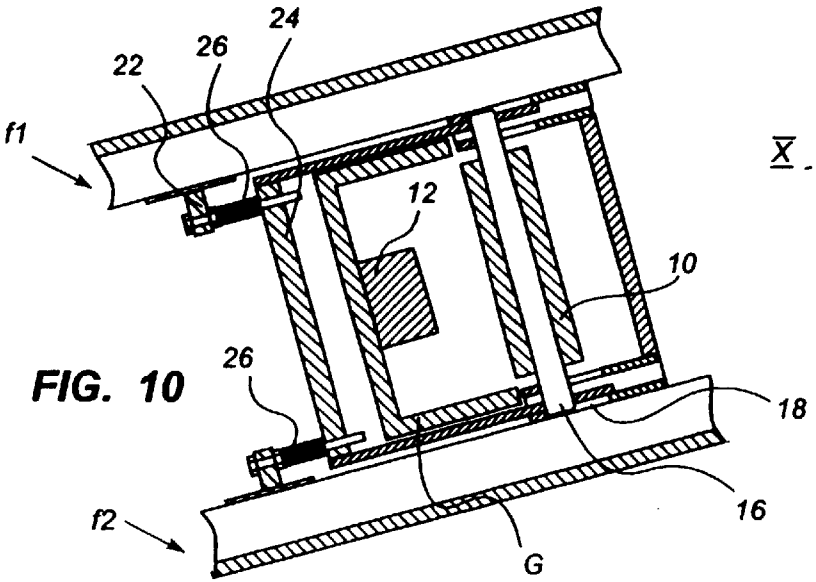
FIG. 10 is an enlarged cross-section taken along lines X—X of FIG. 7.

Chain I extends along and is slidingly supported by a lining 12 affixed to the bottom of the U-shaped rail G by screws 14 (FIG. 9). The lining is preferably made of an anti-friction material such as TEFLON.

The second lever arm section $F5_{3''}$ is coupled to the bridging link 10 by a pin 16, so that the arm can rotate about it during the travel of the arm along the arcuate path of the parallelogram system as explained above.

Figure 8:
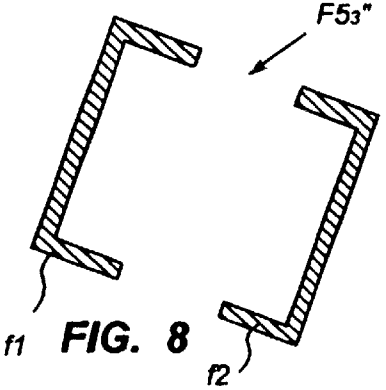
FIG. 8 is a cross-section taken along lines VIII—VIII of FIG. 7.

Pin 16 passes through a slot 18 formed in a bracket-like housing located between bars f1 and f2 composing together the lever arm $F5_{3''}$ (see FIG. 8). The housing comprises mounting plates 20, to which a pair of projecting ribs 22 are welded. Bracket 24 is mounted to bridging link 10 by means of pin 16, and is loaded by compression springs 26 in a direction away from the rail G. Therefore, in the normal operative state, the bridging-link 10 is constantly raised from the lining 12. If however the chain becomes loose, slack, torn or broken, the bracket will shoot against the rail G under the tension of the springs 26, and will abut against the nearest one of stop protrusions g that are deployed along the bottom of rail G, to prevent further movement of the linkage arm F3. The arrangement thus serves as a safety measure against a motorcar falling down in case the chain I breaks or slackens for any reason.

An additional feature of the present invention is illustrated in FIGS. 11 and 12. Preferably pivotable front and rear pairs of flaps L are provided which initially swing downwards to assist a vehicle in mount the platform, and which provide a safety measure when the vehicle is lifted to and/or positioned in the elevated location, as is now explained.

Figure 11A:
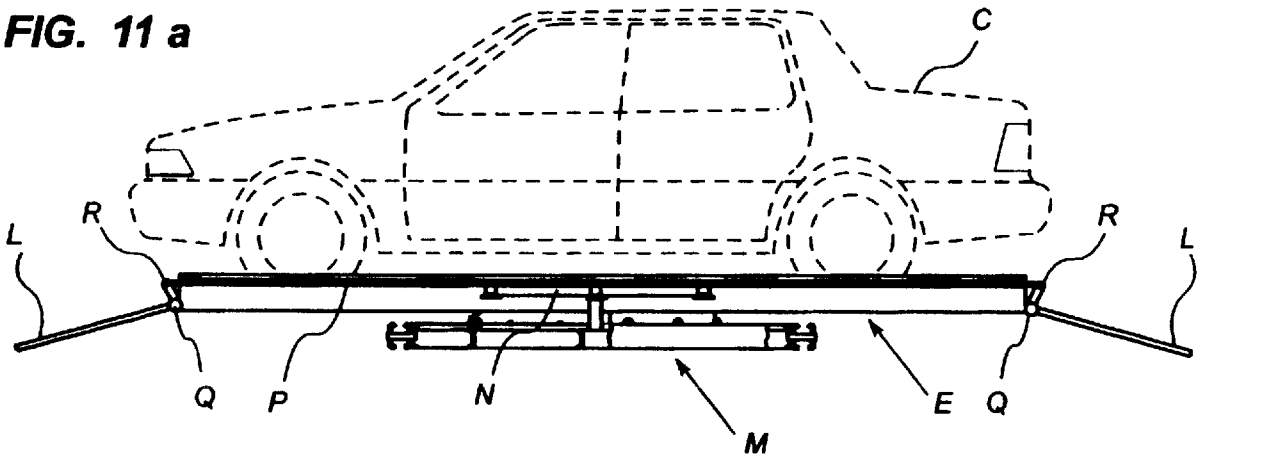
FIG. 11A shows a motorcar on a platform with side flaps in a first, lowered position.
Figure 11B:
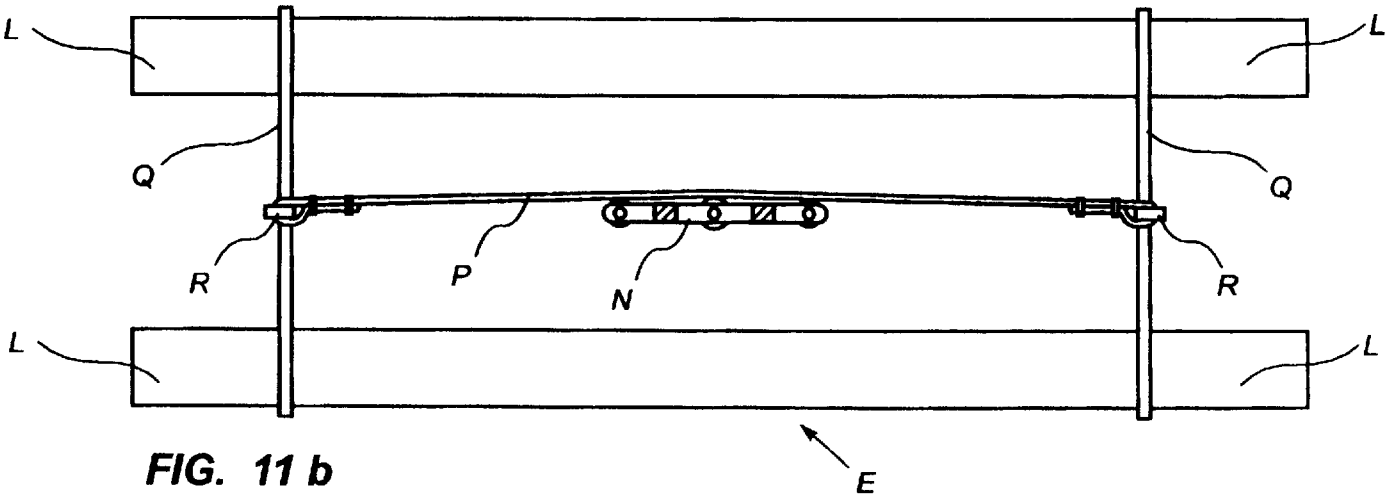
FIG. 11B shows a detail of the platform understructure, comprising an automatic flaps tilting mechanism, in a first position.
Figure 12A:
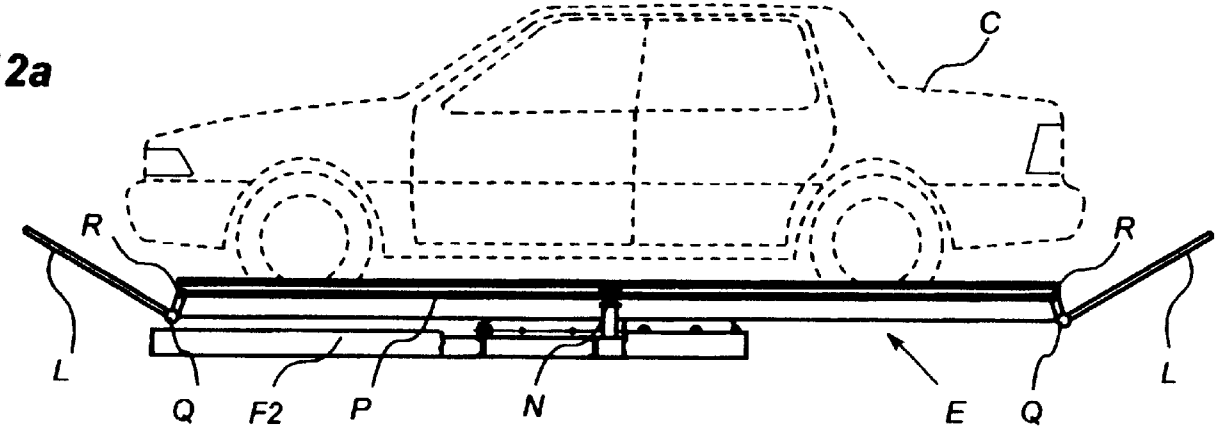
FIG. 12A shows the platform of FIG. 11A in a second, raised position.
Figure 12B:
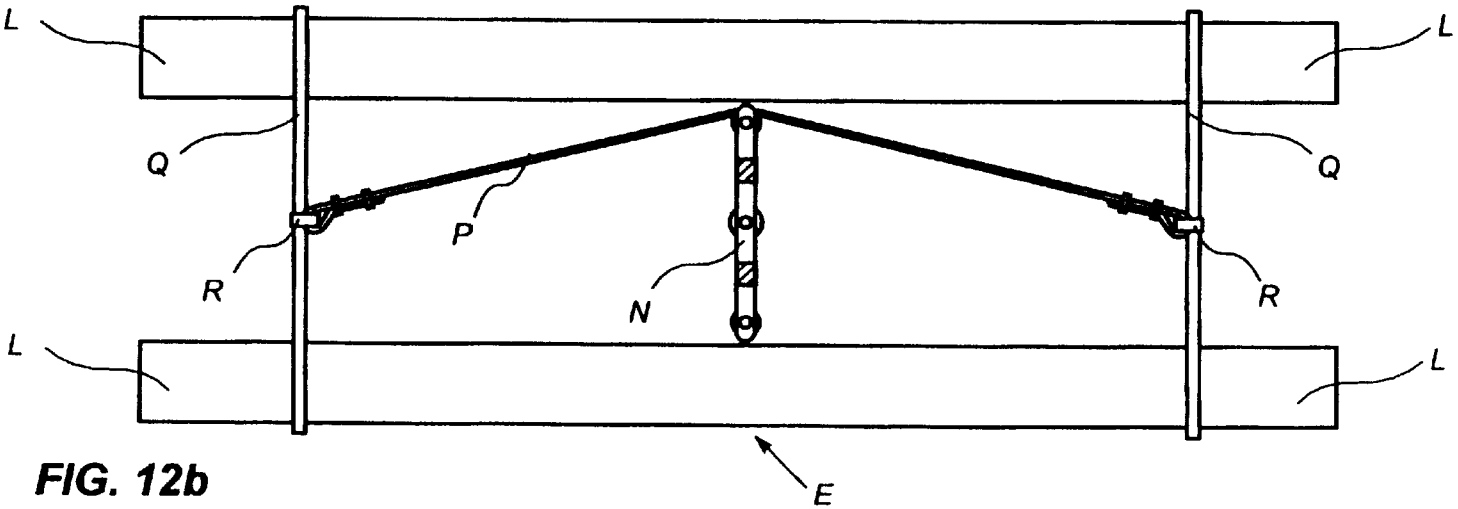
FIG. 12B shows a detail of the platform understructure in the second, raised position.
Figure 13A:
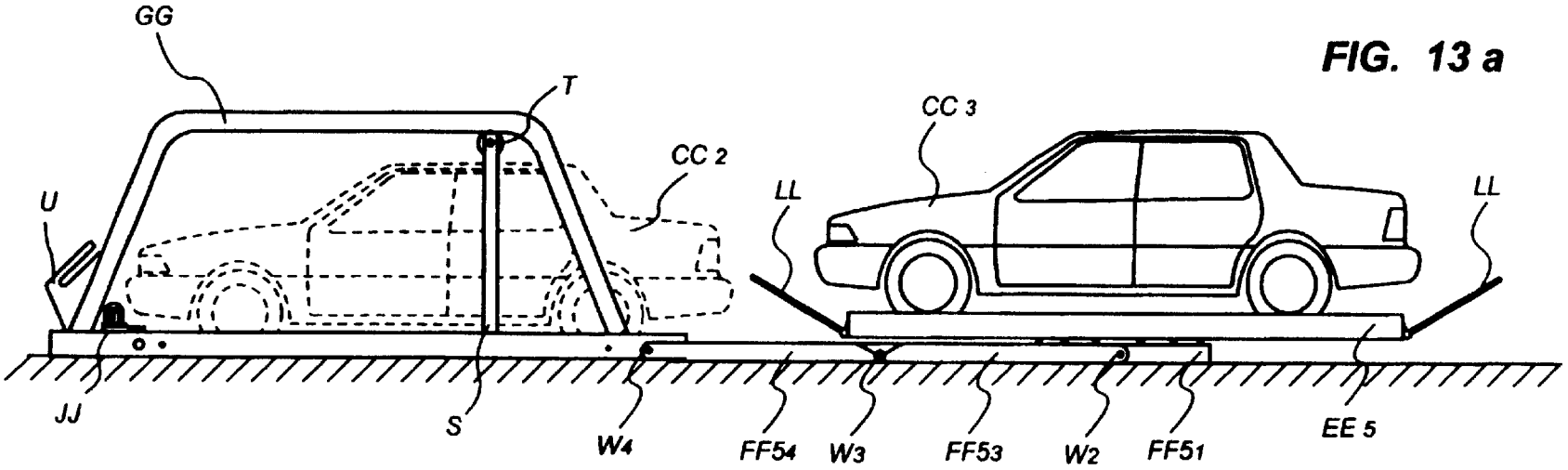
FIGS. 13A and 13B are simplified pictorial and partially enlarged illustrations, respectively, of a modified parking system according to another preferred embodiment of the invention.
Figure 13B:
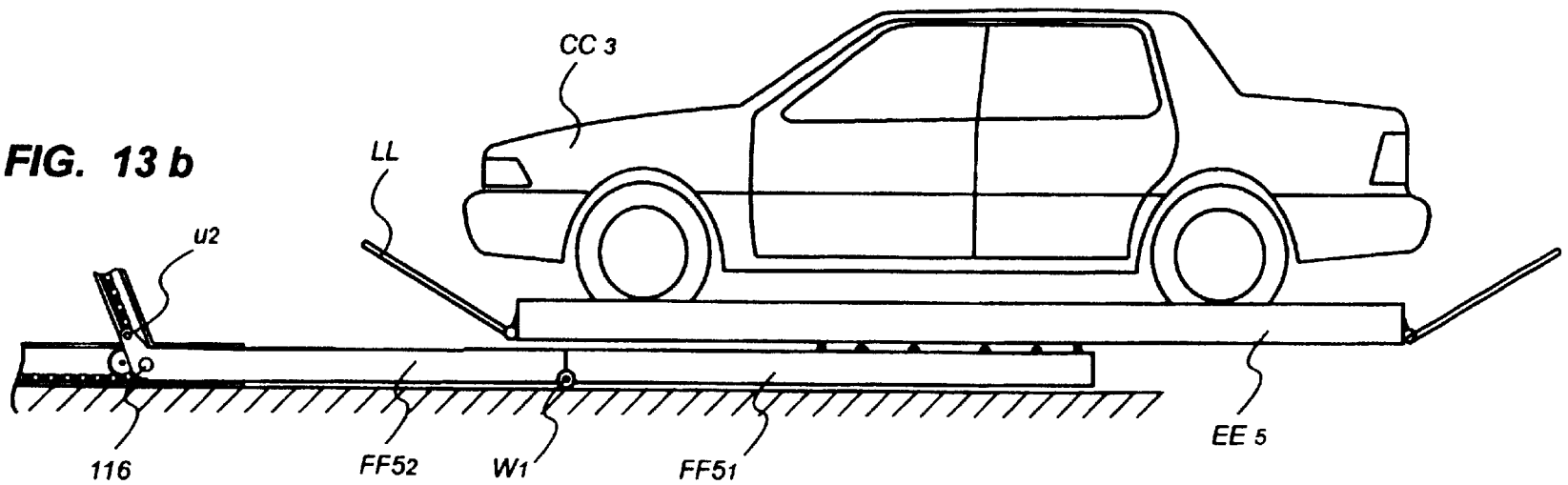

Platform E is rotatable by a revolving system, generally denoted M in FIG. 11A. The system comprises (among other sub-assemblies known per-se in the art and not shown) a support bar N which is affixed to a sub-structure of the platform, and thus is not rotatable therewith.

When platform E is rotated by 90°, bar N functions as a cam for pulling a cable P taut between elbows R of the flaps L, which are pivoted (at Q) to the platform E as shown. In the non-operative position of FIGS. 11A and 11B (conforming to that of FIG. 2), flaps L are tilted downwards for facilitating driving a motorcar onto the platform. When rotated by 90° (FIG. 3) the cable P is pulled taut so that flaps L are turned upwards (FIGS. 12A and 12B) for safeguarding the motorcar against accidental slipping off the platform E.

Reference is now made to FIGS. 13A–18 which illustrate a modified parking system according to another preferred embodiment of the invention. Since the parking system of FIGS. 13A–18 is similar to the parking system previously described hereinabove, only the modifications will be described in detail.

Instead of supports G, in the modified embodiment supports GG are employed which are lower in height and have a generally inverted U-shape.

The lever arm system comprises a turntable support platform $FF5_1$ and a pair (one at each side) of arms $FF5_2$. These arms are hinged (at W1) to the front end of the platform $FF5_1$. For a reason to be explained further below, hinges W1 are of such construction that rotation of the arm $FF5_2$ relative to the platform $FF5_1$ by over 180° (in the clockwork direction) is blocked; only rotation of the arm $FF5_2$ in the anti-clockwise direction is allowed.

Figure 18:
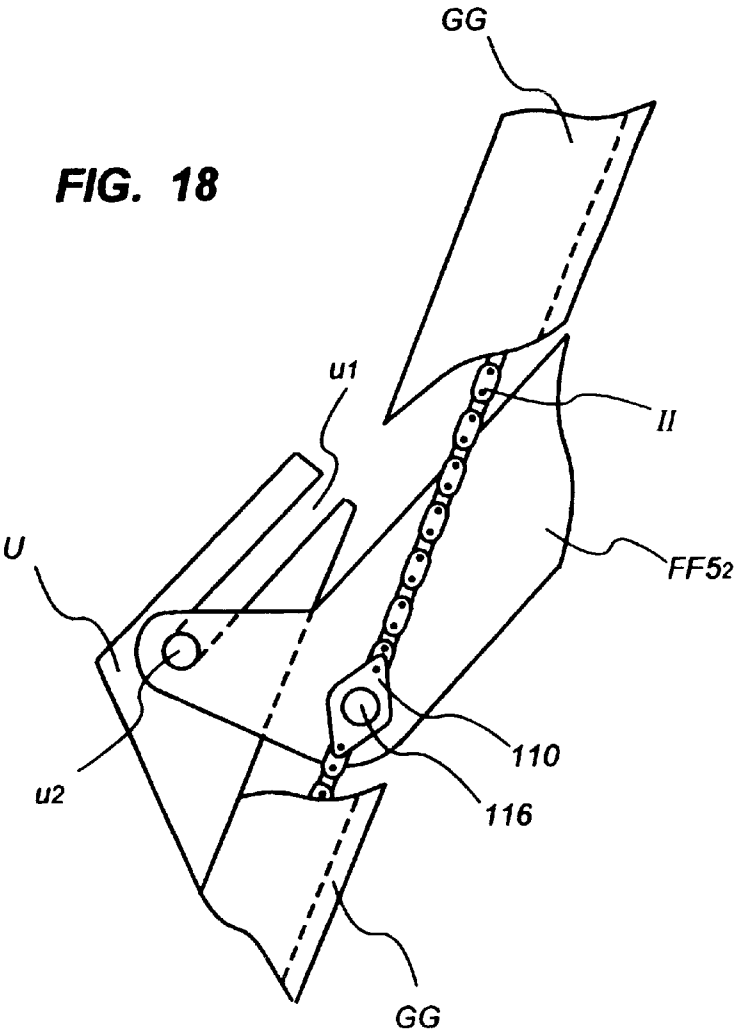
FIG. 18 is a detail of a chain stopping arrangement.

As will be further noted, the arms $FF5_2$ are coupled to a chain II by pivot pins 116 (analogous to pin 16 of the previous embodiment) and bridging links 110 (see FIG. 18). Stop pins U2 are mounted to nose portions of the arm $FF5_2$, adapted to slidingly fit into slot U1 formed in stop members U. A pair of lever arms $FF5_3$ pivotally connected (at W2) to platform $FF5_1$ at one end, and a pair of lever arms $FF5_4$ pivotally connected (at W3) to the other end of arm $FF5_3$ and (at W4) to the main structure at its other end.

Preferably a pair of vertical support bars S are provided, located as shown and somewhat inwardly with respect to the supports GG, carrying at their top freely rotatable rollers T. As will be explained below, the function of the rollers T is to support, during movement thereover, first the lever arm $FF5_2$ and then the platform $FF5_1$.

The general operation of the system is analogous to that of the previously described embodiment, as is now described with reference to FIGS. 14 and 15.

Figure 14:
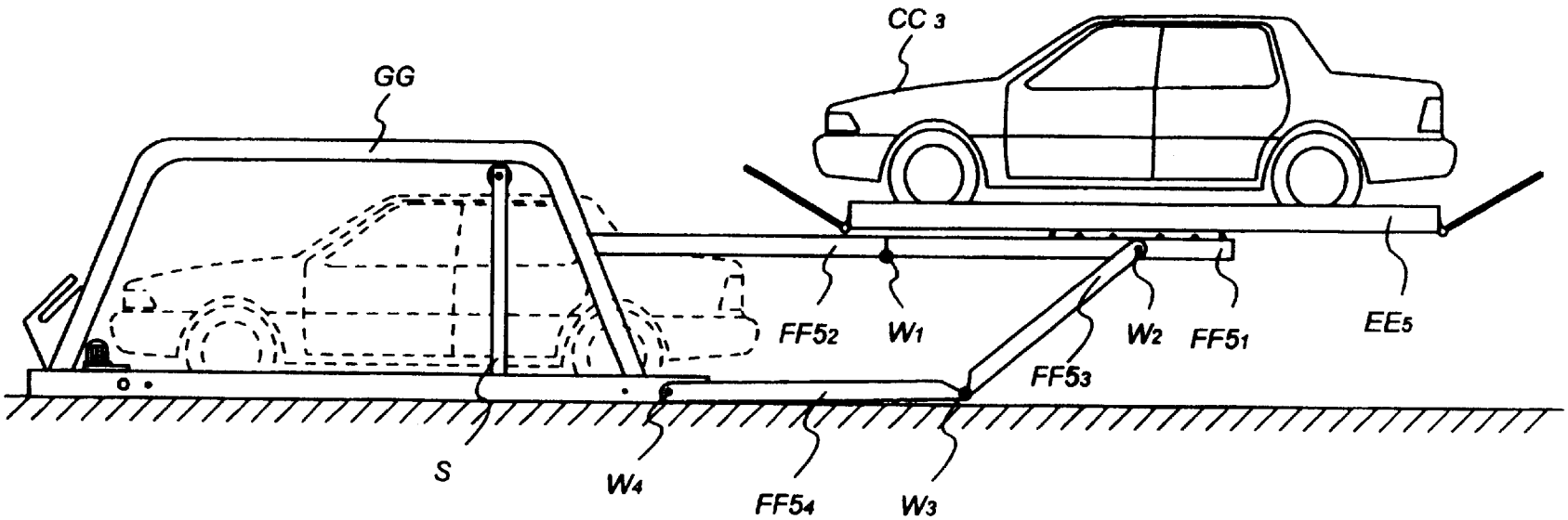
FIG. 14 illustrates the system of FIGS. 13A and 13B in an intermediate parking stage.
Figure 15:
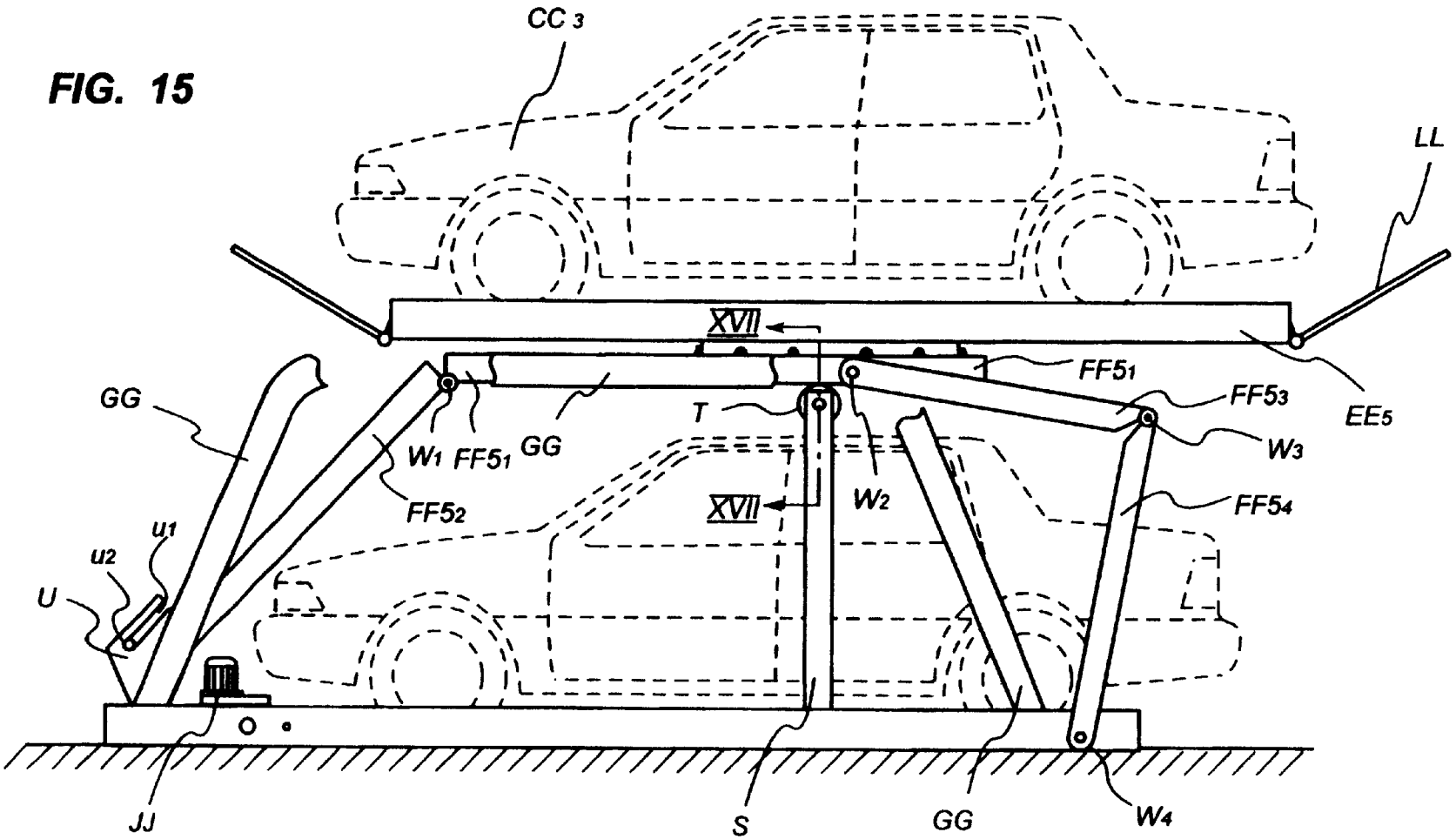
FIG. 15 illustrates a final parking stage.
Figure 16:
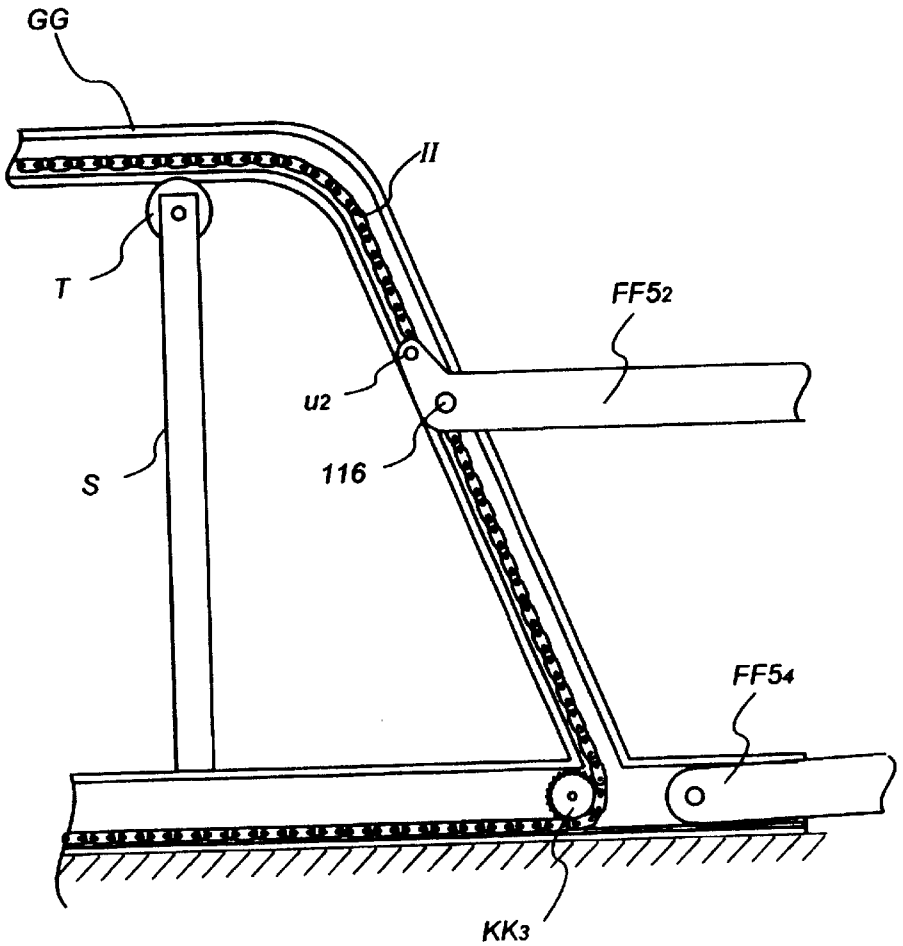
FIG. 16 is a fragmental view, on an enlarged scale, of a chain traction system of the system of FIGS. 13A and 13B.
Figure 16:
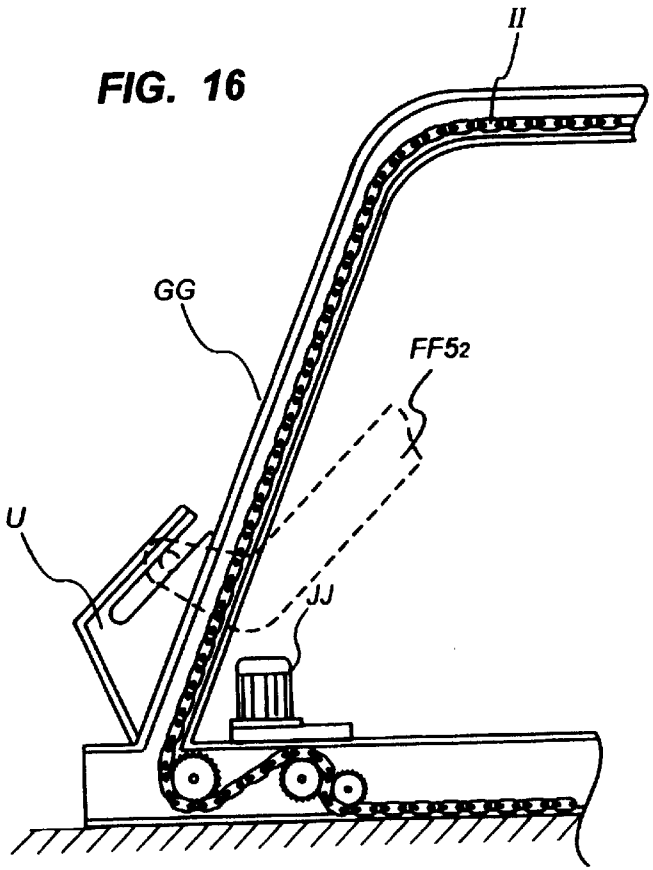
Figure 17:
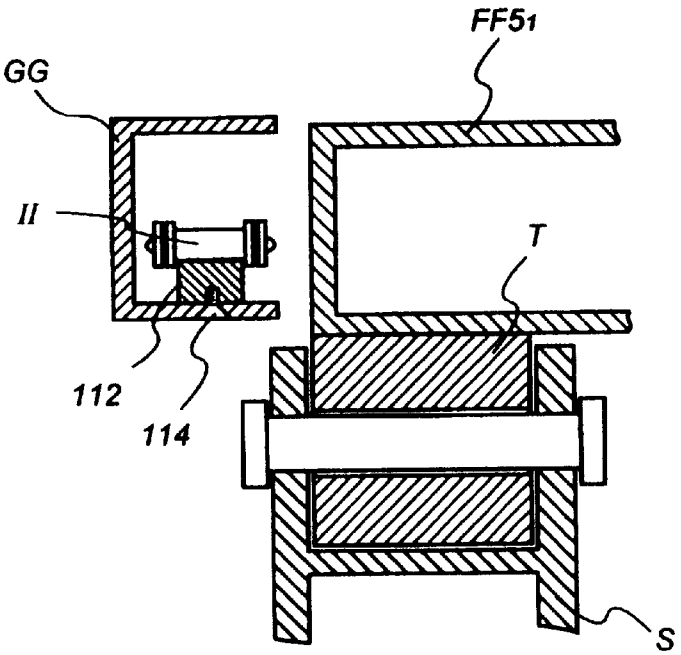
FIG. 17 is a section taken along lines XVII—XVII of FIG. 15.

When a motor JJ is started and the chain II rotates (in the anti-clockwise direction), the arms $FF5_2$ and platform $FF5_1$ move upwards, as a unitary beam, due to blocked position of the hinge W1 (FIG. 14). The parallel-to-itself lifting movement continues for as long as the front end of the lever arms $FF5_2$, with pins 116 connected to the chain II, run along the first climbing stretch of the support rails GG, as well as part of the upper, linear portion thereof. During this travel, the arms $FF5_2$, and in turn the platform $FF5_1$, glide on the roller T, as shown in FIG. 17. In FIG. 17, it is seen that chain II preferably glides along a low-friction support 112 preferably secured by a screw 114 to support rails GG.

When the chain coupling point (pin 116) reaches the end of the linear portion, it starts to descend along the descending stretch of the structure rails GG, and the arms $FF5_2$ follow suit, pivoting downwards relative to the platform $FF5_1$ which remains horizontal. The load of the car is thus mainly supported by the vertical support bar S, and only fractionally by the combination of the lever arm $FF5_2$ (coupled to the chain II), at one side, and the arm FF4 coupled to the mains structure (at W4), at the other side. Consequently, the constructions of the respective lever arms can be lighter relative to that of the previous embodiment. The lifting cycle is terminated by the stop pin U2 reaching into the slot U1 and sliding all alone down to its end (see FIG. 18). Preferably motor JJ is automatically switched off, e.g. by a microswitch.

Reference is now made to FIGS. 19A–19K which illustrate a parking system 100 constructed and operative in accordance with yet another preferred embodiment of the invention. Since parking system 100 is similar to the parking system previously described hereinabove with reference to FIGS. 13A–18, only the modifications will be described in detail.

In parking system 100, platforms $FF5_1$ and $FF5_2$ are referred to as support structure 101 comprising a main platform 101A and a secondary platform 101B, and lever arms $FF5_3$ and $FF5_4$ are referred to as lever arms 103 and 104, respectively. Support rails GG and motor JJ are referred to as support frame 106 and drive apparatus 108, respectively. The improvements in parking system 100 over the previously described embodiments of the present invention include, inter alia, the addition of lever arms, as is now described.

Each lever arm 104 (one being seen in the drawings, the other being generally parallel thereto) is preferably pivotably attached at one end thereof to support frame 106 at a pivot 110, and at an opposite end thereof to lever arm 103 at a pivot 112. Each lever arm 103 is pivotably attached at an opposite end thereof to an additional lever arm 114 at a pivot 116. Each lever arm 114 is pivotably attached at an opposite end thereof to another additional lever arm 118 at a pivot 120. Finally, each lever arm 118 is pivotably attached at an opposite end thereof to yet another, preferably shorter, lever arm 122 at a pivot 124. Each lever arm 122 is pivotably attached at an opposite end thereof to support structure 101 at a pivot 126. Main platform 101A is pivotally connected at a pivot 125 to secondary platform 101B which is in turn pivotally connected at a pivot link 127 to support frame 106.

Figure 19A:
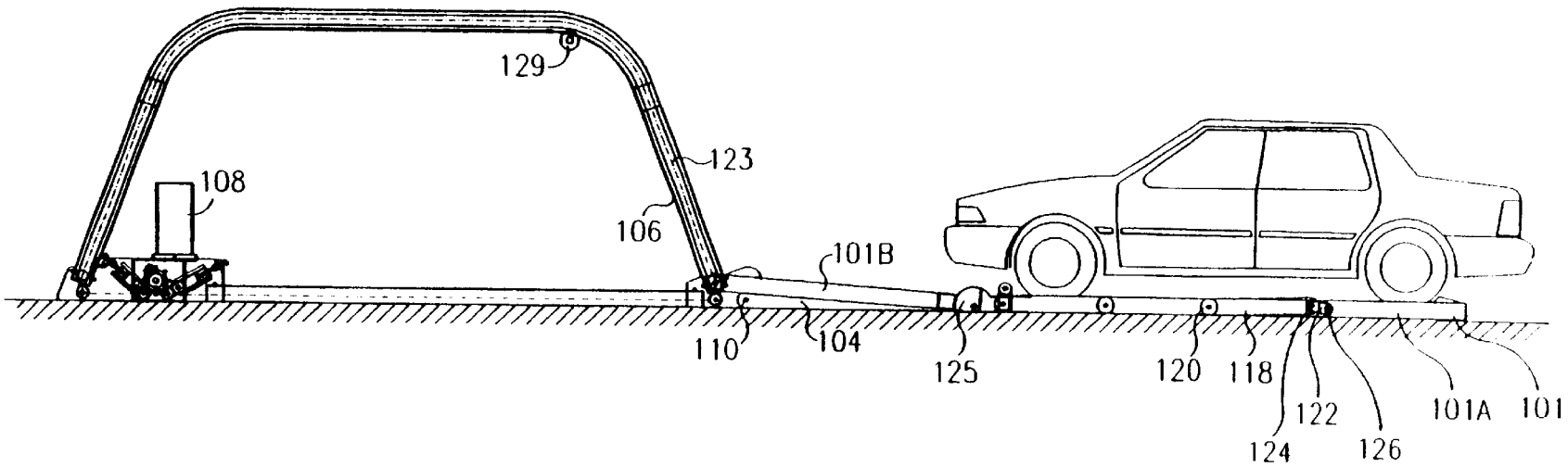
FIGS. 19A–19K are simplified pictorial illustrations of a parking system constructed and operative in accordance with yet another preferred embodiment of the invention, respectively prior to, during and after lifting a vehicle onto a support frame.

As can be seen in FIG. 19A, a chain drive 123 (shown in dashed lines in the figure) is preferably operatively connected to drive apparatus 108 and engages pivot link 127 of platform 101B. Chain drive 123 is preferably constructed as described hereinabove with reference to FIGS. 6 and 7 for chain I, although other drive mechanisms can be employed as well, such as flexible belt drives or timing belts, for example. Drive apparatus 108 can be mounted near support frame 106 as shown, or can be mounted in some hidden area, if desired.

It is noted that, unlike the embodiment shown in FIGS. 13A–18, in parking system 100 there is no vertical support bar S and support structure 101 does not glide on any roller. Instead the vehicle is supported first by the lever arms and then by frame 106. A cross bar 129 may be provided but it does not support any vehicle weight, rather serves as a height marker for safety purposes. Eliminating support bar S provides better access to the ground-level parking space.

Lever arms 104, 103, 114, 118 and 122 are serially and pivotally connected to each other from a nearest lever arm 104 to a furthest lever arm 122, "near" and "far" being defined in terms of distance from pivot 110. Each lever arm is movable from a first orientation (e.g., horizontal) to a second orientation, wherein an angle of each lever arm relative to the ground surface is greater in the second orientation than in the first orientation, as will now be described.

By following the motion of the lever arms in FIGS. 19A–19K, it can be seen that drive apparatus 108 sequentially lifts each pair of lever arms, starting with the furthest lever arm 122 and ending with the nearest lever arm 101B, from the first orientation to the second orientation. At least one lever arm constantly contacts the ground surface before drive apparatus 108 lifts the next furthest lever arm from the first orientation to the second orientation.

In FIG. 19A, the vehicle has just been parked on support structure 101.

Figure 19B:
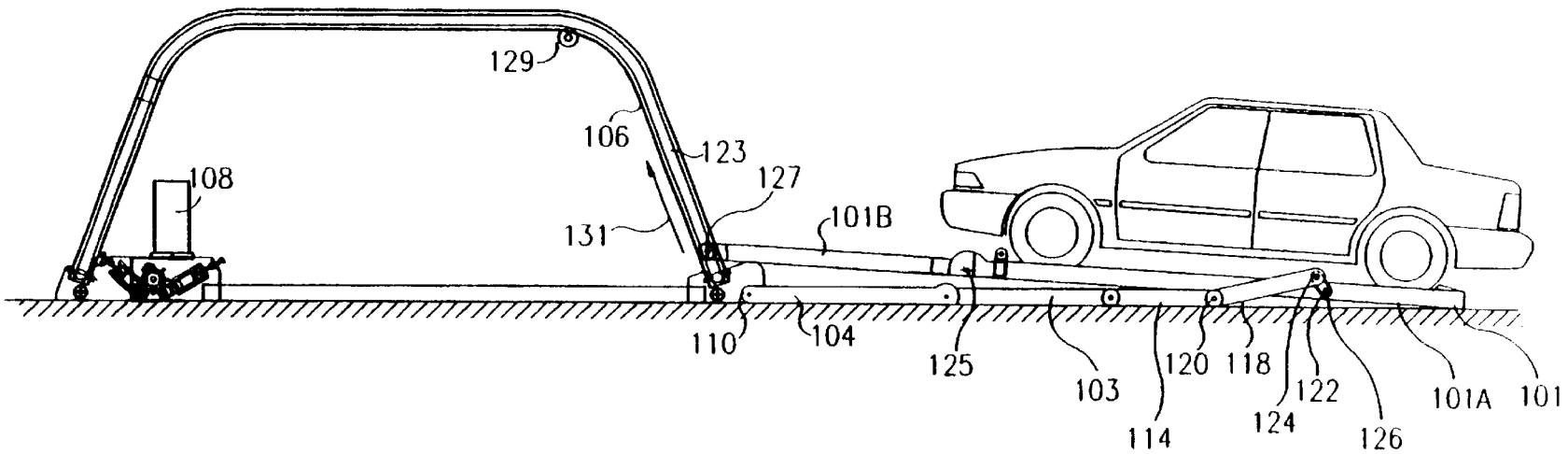

In FIG. 19B, drive apparatus 108 drives pivot link 127 up frame 106 in the direction of an arrow 131, and lever arm 122 pivots clockwise about pivot 126 and lever arm 118 pivots counterclockwise about pivot 120. Lever arms 103, 104 and 114 remain on the ground. The far end of platform 101A also contacts the ground.

Figure 19C:
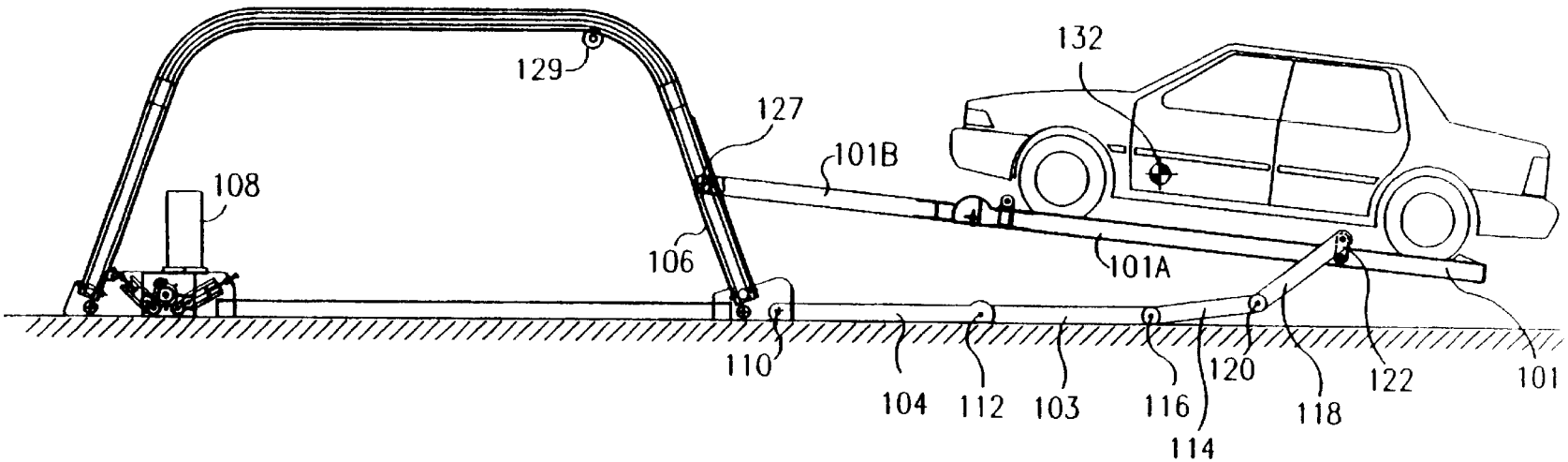

In FIG. 19C, drive apparatus 108 continues to drive pivot link 127 up frame 106. Lever arm 118 continues counterclockwise movement about pivot 120, and lever arm 114 starts to pivot counterclockwise about pivot 116. Lever arms 103 and 104 remain on the ground. Platform 101A is now lifted above the ground. The center of gravity 132 of the vehicle is positioned slightly to the right of or above pivot 116. This means that the total moment produced by the weight of the vehicle and the weight of the support structure 101 on the far side of pivot 116 is more than balanced by the total moment produced by the weight of support frame 106 and support structure 101 acting on the near side of pivot 116. It is a particular feature of the present invention, that since the forces and overturning moments acting on support frame 106 are relatively small and insignificant, the frame does not have to be anchored to the ground.

Figure 19D:
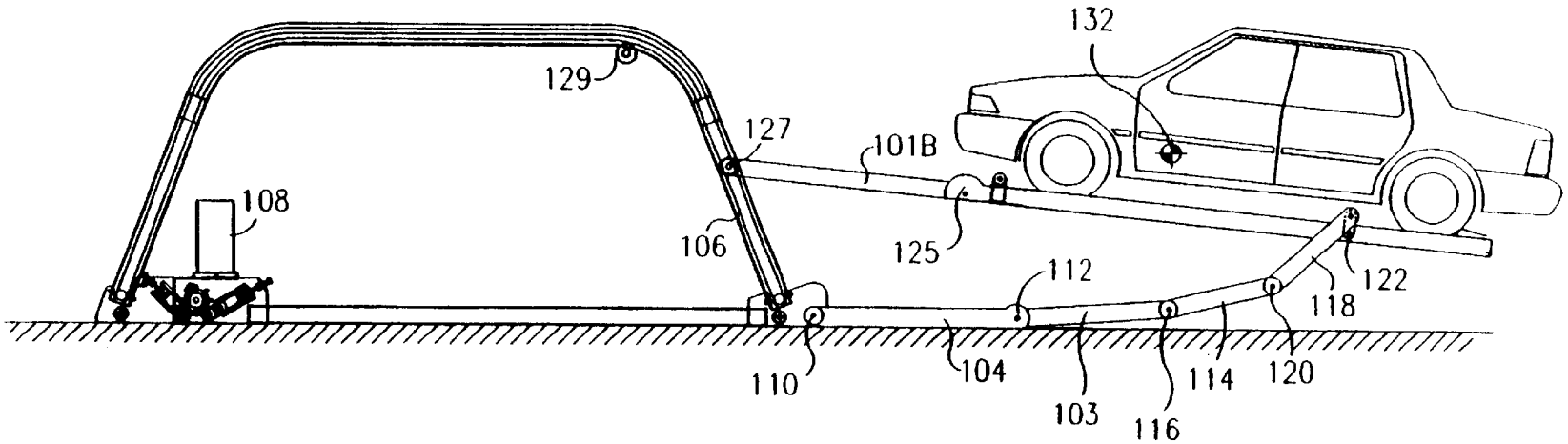

In FIG. 19D, drive apparatus 108 continues to drive pivot link 127 up frame 106. Lever arm 114 continues counterclockwise movement about pivot 116, and lever arm 103 starts to pivot counterclockwise about pivot 112. Lever arm 104 remains on the ground. The center of gravity 132 of the vehicle is positioned to the right of pivot 112. On account of the relatively short length of lever arm 103 plus the fact that some of the vehicle weight is vertically supported at pivot link 127 by the right side of support frame 106, the total moment produced by the weight of the vehicle and the weight of the support structure 101 on the far side of pivot 112 is more than balanced by the total moment produced by the weight of support frame 106 and support structure 101 acting on the near side of pivot 112.

Figure 19E:
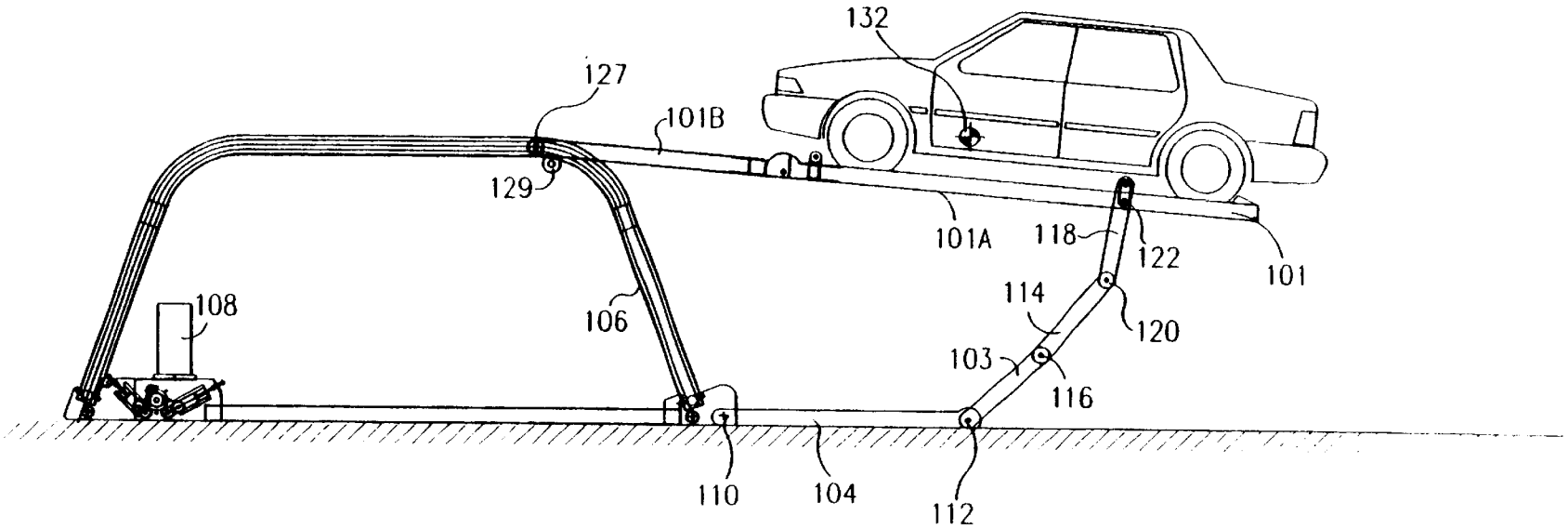

In FIG. 19E, drive apparatus 108 has lifted pivot link 127 up to the horizontal portion of frame 106 past cross bar 129. Platforms 101A and 101B are virtually coplanar, i.e., do not pivot about pivot 125. Lever arm 122 is now almost collinear with lever arm 118. Lever arm 104 remains on the ground. The center of gravity 132 of the vehicle is positioned over the right end of lever arm 104, so there continues to be virtually no overturning moment acting on support frame 106.

Figure 19F:
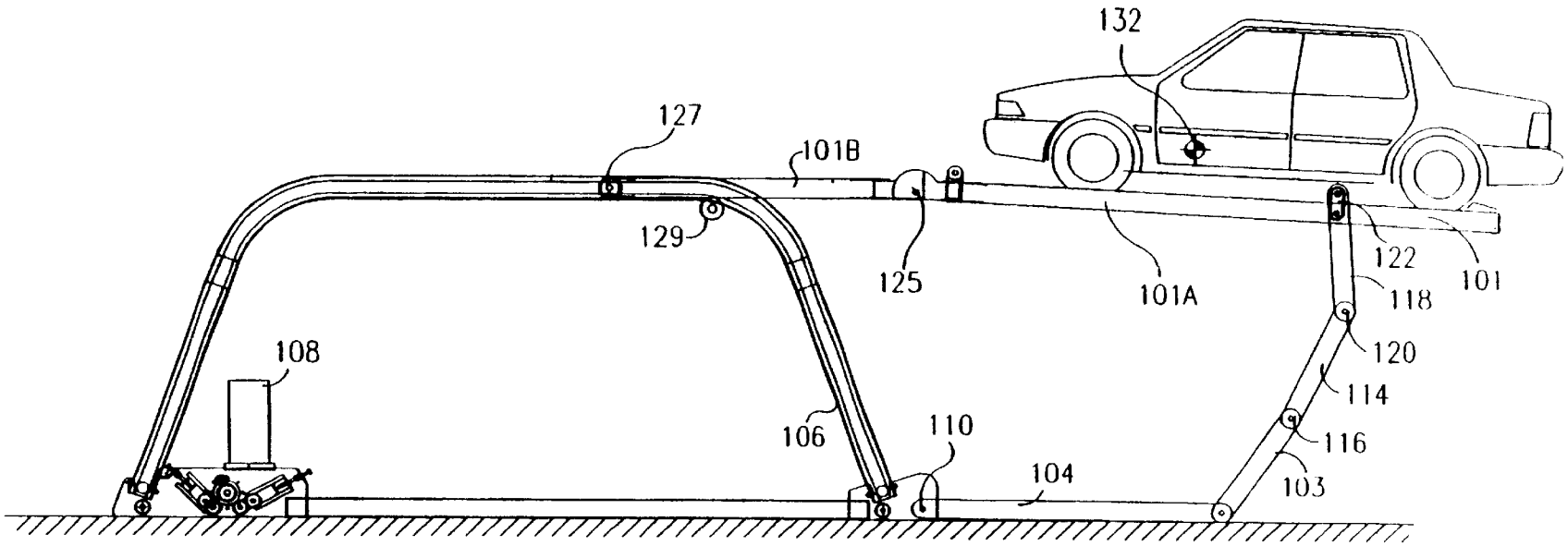

In FIG. 19F, drive apparatus 108 has moved pivot link 127 further left in the sense of the figure. Platforms 101A and 101B are now slightly pivoted with respect to each other about pivot 125. Lever arms 122 and 118 are now pivoted slightly to the left of pivot 120. Lever arm 104 remains on the ground.

Figure 19G:
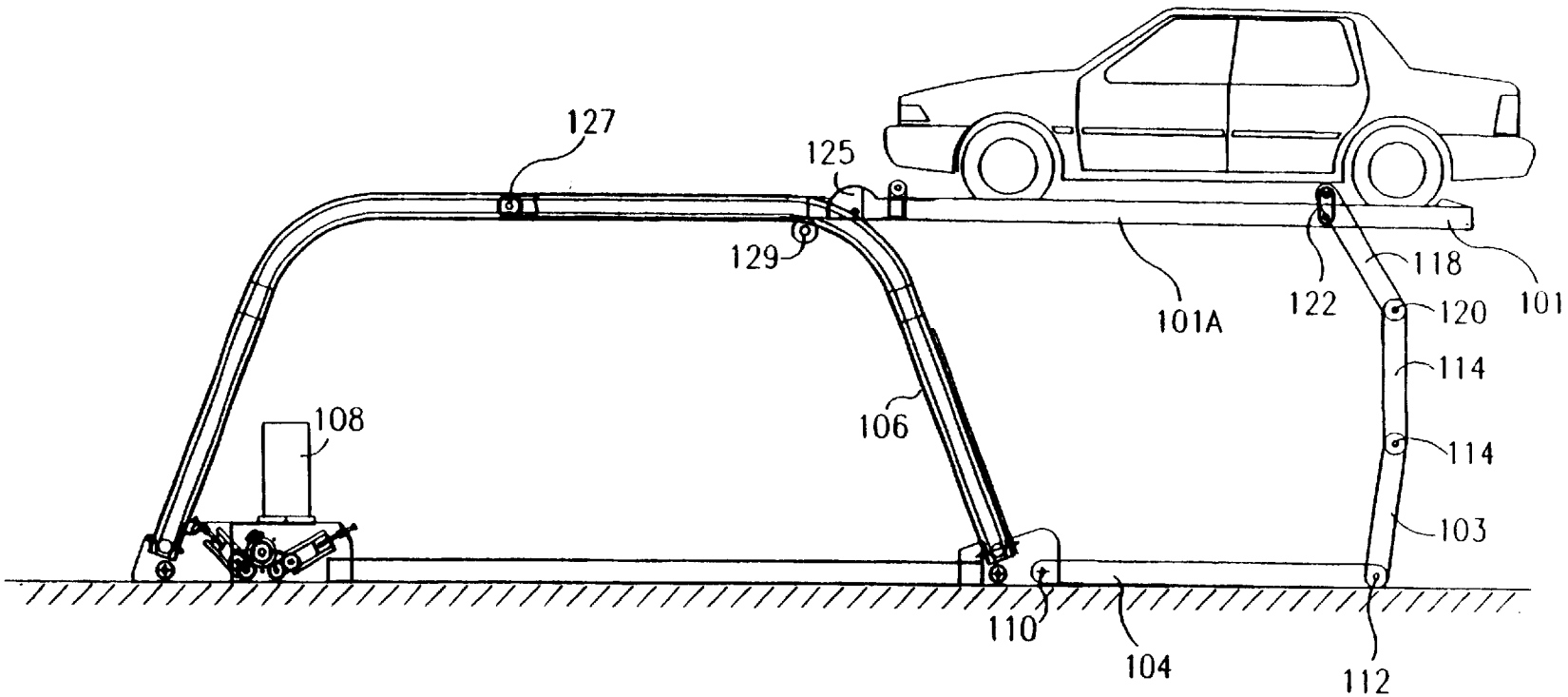

In FIG. 19G, drive apparatus 108 continues to move pivot link 127 further left in the sense of the figure, and lever arms 122 and 118 accordingly move further left. Lever arm 104 remains on the ground.

Figure 19H:
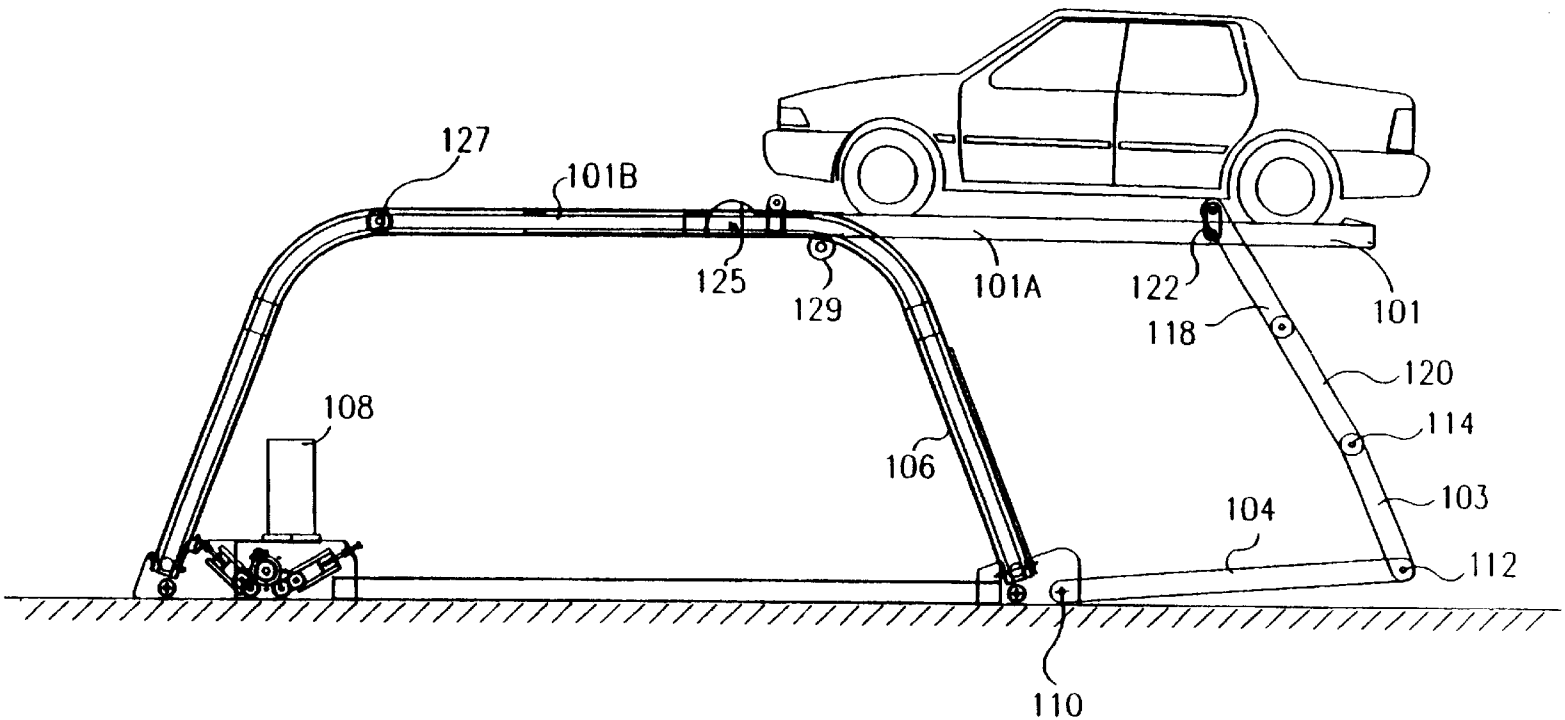

In FIG. 19H, drive apparatus 108 continues to move pivot link 127 further left in the sense of the figure, and lever arms 118, 114 and 103 are almost collinear. Lever arm 104 starts to pivot counterclockwise about pivot 110.

Figure 19I:
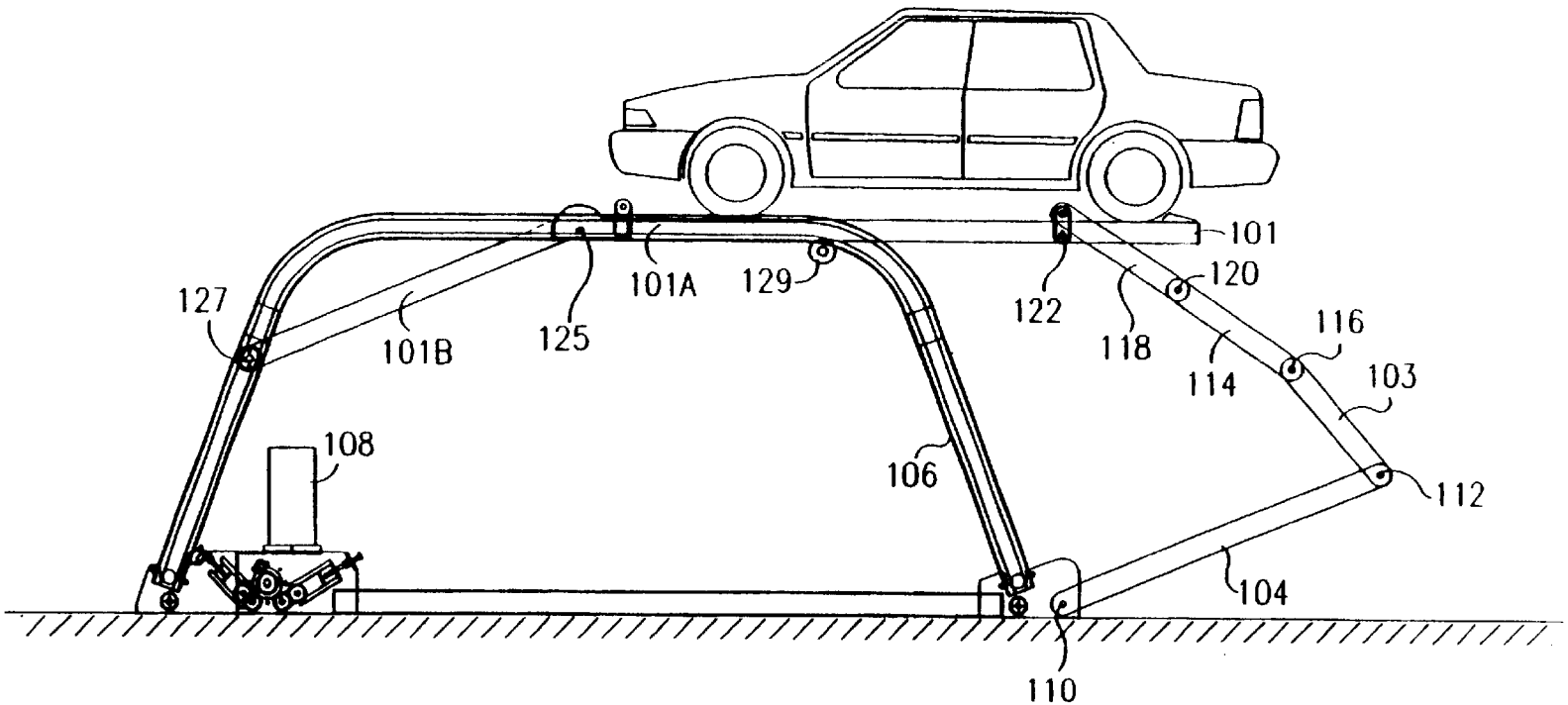

In FIG. 19I, drive apparatus 108 has moved pivot link 127 to the left descending portion of frame 106, and platform 101B is thus pivoted with respect to platform 101A about pivot 125. Lever arm 104 continues to pivot counterclockwise about pivot 110.

Figure 19J:
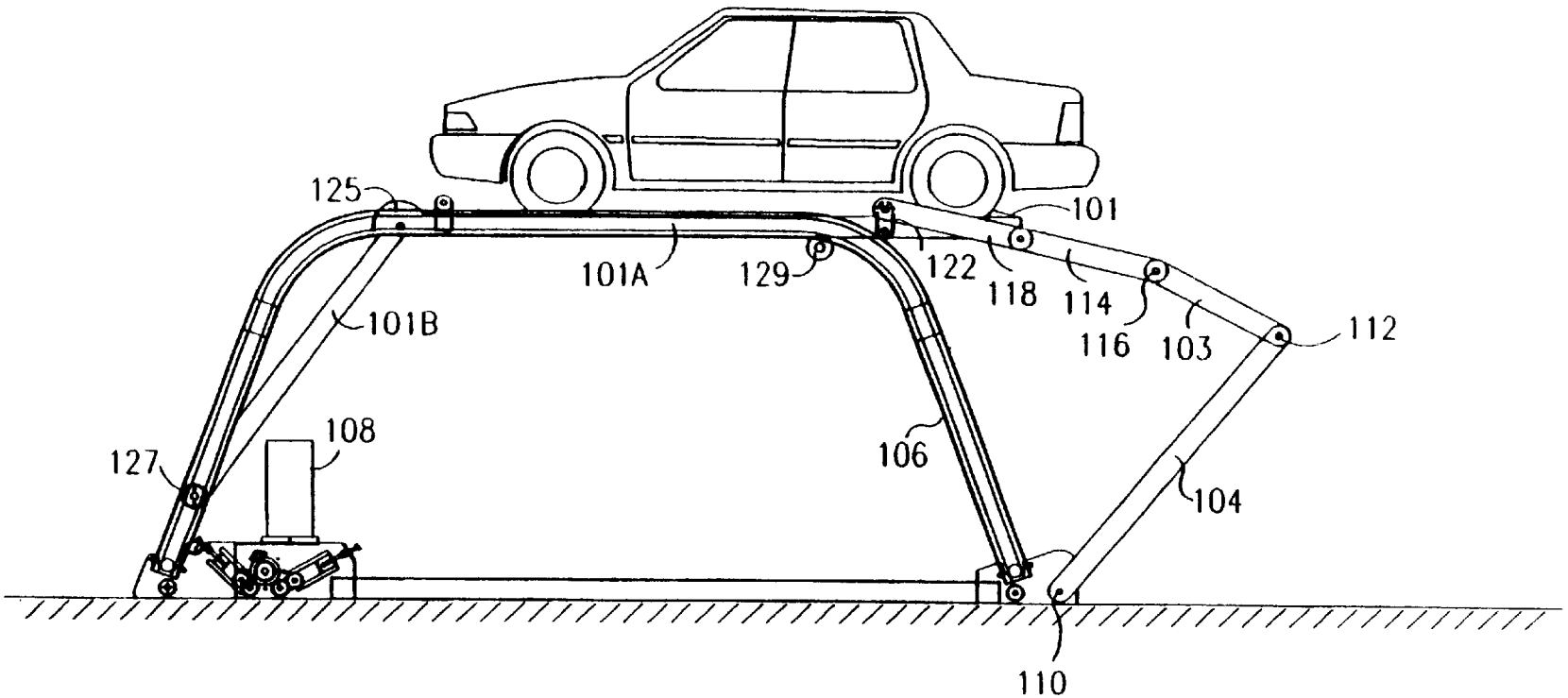

In FIG. 19J, drive apparatus 108 continues to move pivot link 127 down the left descending portion of frame 106.

Lever arm 122 approaches the horizontal portion of frame 106. Lever arm 104 starts to pivot counterclockwise about pivot 110.

Figure 19K:
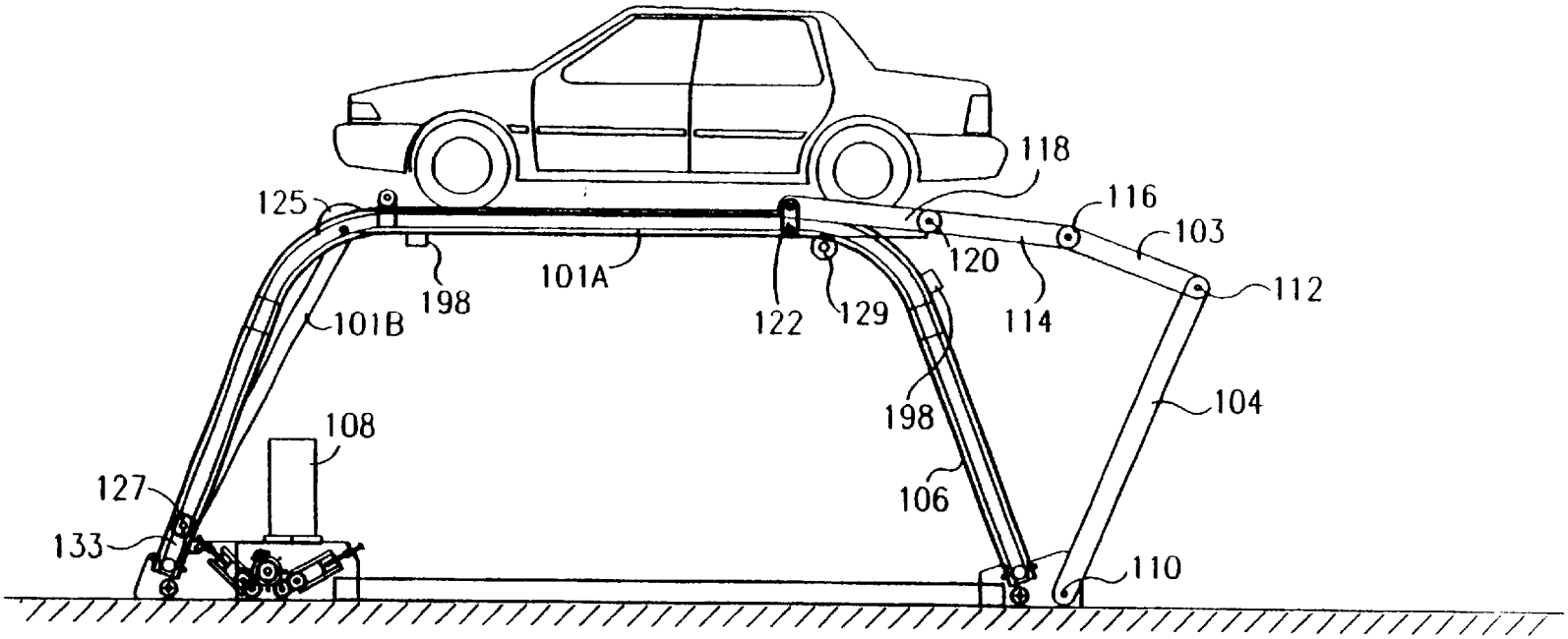

Finally in FIG. 19K, drive apparatus 108 has moved pivot link 127 down to a stop 133 on the left descending portion of frame 106. Lever arm 122 is now positioned on the horizontal portion of frame 106, and frame 106 supports the full weight of the vehicle.

It is thus appreciated that throughout the motion of the lever arms, the furthest ground-contacting lever arm of those lever arms which contact the ground surface is pivotably connected at a reference pivot to the nearest lever arm of those lever arms which have been lifted above the ground surface to the second orientation. Drive apparatus 108 lifts the lever arms such that the center of gravity of the vehicle is constantly positioned with respect to the reference pivot such that the total moment produced by the weight of the vehicle and the weight of the support structure 101 on the far side of the reference pivot is not greater than the total moment produced by the weight of support frame 106 and support structure 101 acting on the near side of the reference pivot. Since the forces and overturning moments acting on the frame are relatively small and insignificant, the frame does not have to be anchored to the ground. The addition of short lever arms significantly improves the mechanical advantage of the parking system because the chain drive always works to lift lever arms which are relatively shorter than any heretofore used in the prior art, and thus must overcome relatively smaller moments. The improved mechanical advantage allows using a relatively inexpensive and smaller motor.

Lowering of the vehicle from support structure 106 is preferably accomplished by simply reversing the actuating direction of drive apparatus 108. Drive apparatus 108 can preferably be operated manually, such as by means of a hand crank, so that a vehicle can be lifted or lowered in the event of an electrical failure or blackout.

In accordance with a preferred embodiment of the present invention, in order to increase safety, a sensor 198 is mounted on or in the vicinity of the lever arms or support frame 106 (shown in FIG. 19K) for sensing and verifying the absence of a person within a predefined zone with respect to the lever arms or support frame 106. For example, one sensor 198 may be used to sense and verify that no one is standing underneath the vehicle when the vehicle is atop frame 106. Additionally or alternatively, another sensor 198 may be used to sense and verify that no one is standing at the far end of frame 106 when it is desired to lower the vehicle from frame 106. A suitable sensor for such a purpose is an ultrasonic transceiver or other suitable sensor which transmits energy into a volume and senses energy reflected therefrom, as described in published PCT patent application WO97/17520, the disclosure of which is incorporated herein by reference, and commercially available from Sensotech Ltd., Petach Tikva, Israel.

The present invention also provides apparatus for preventing theft of a vehicle parked on the ground level of the parking system, as is now described.

Reference is now made to FIGS. 20–23 which illustrates a locking mechanism 150 for locking the wheels of a vehicle parked on the ground level of the parking systems of the present invention, constructed and operative in accordance with a preferred embodiment of the present invention.

Figure 21:
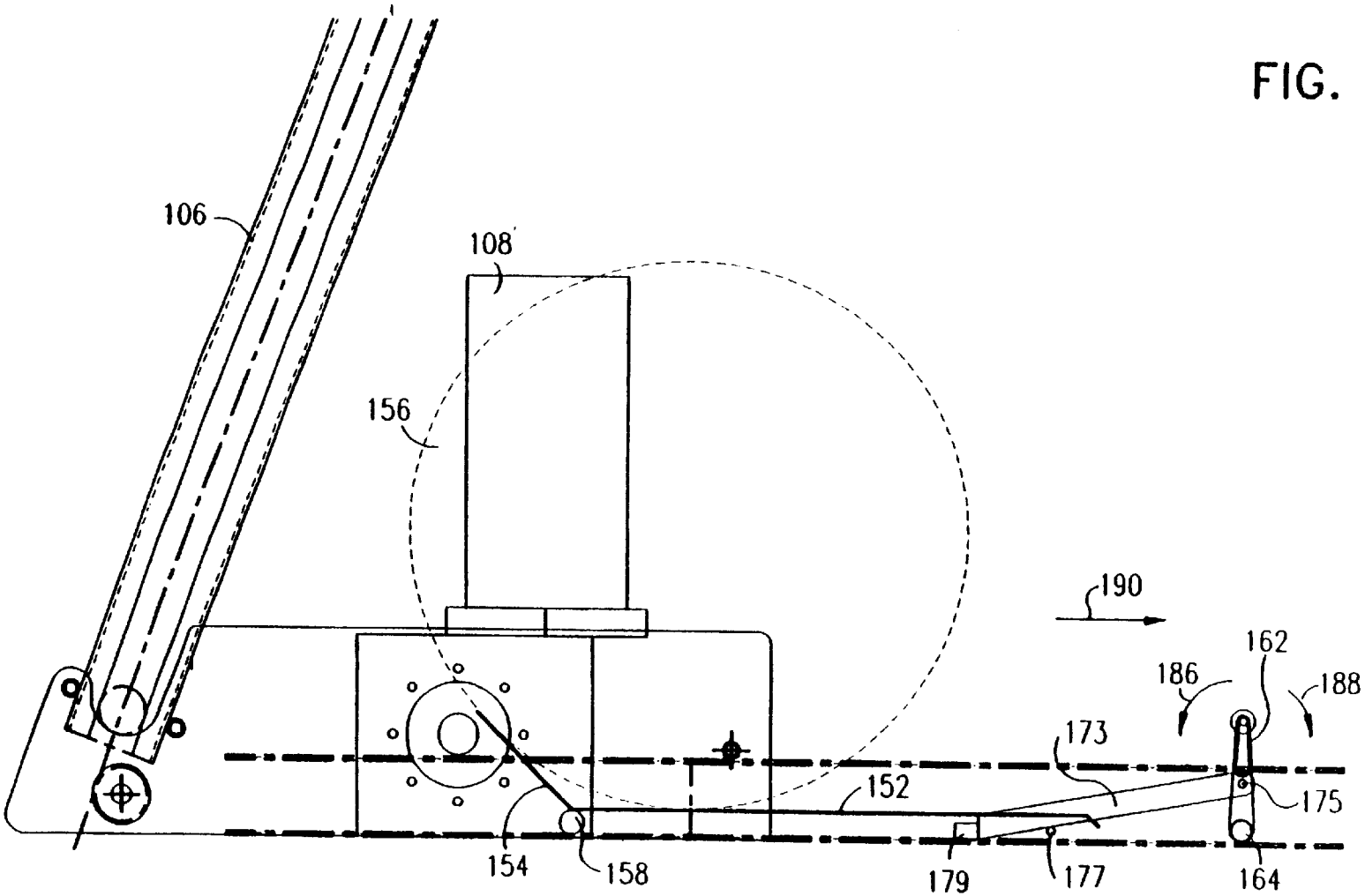

Locking mechanism 150 preferably includes a pair of platforms 152 spaced from each other in accordance with a standard spacing between tires of a typical vehicle. Alternatively one wide platform may be provided. Each platform 152 is preferably formed of a bent, resilient sheet which has a wheel stop 154 extending therefrom against which a tire 156 of a vehicle can abut (as seen in FIG. 21). Platform 152 may rest on a rod 158 at the junction between platform 152 and wheel stop 154.

Figure 22:
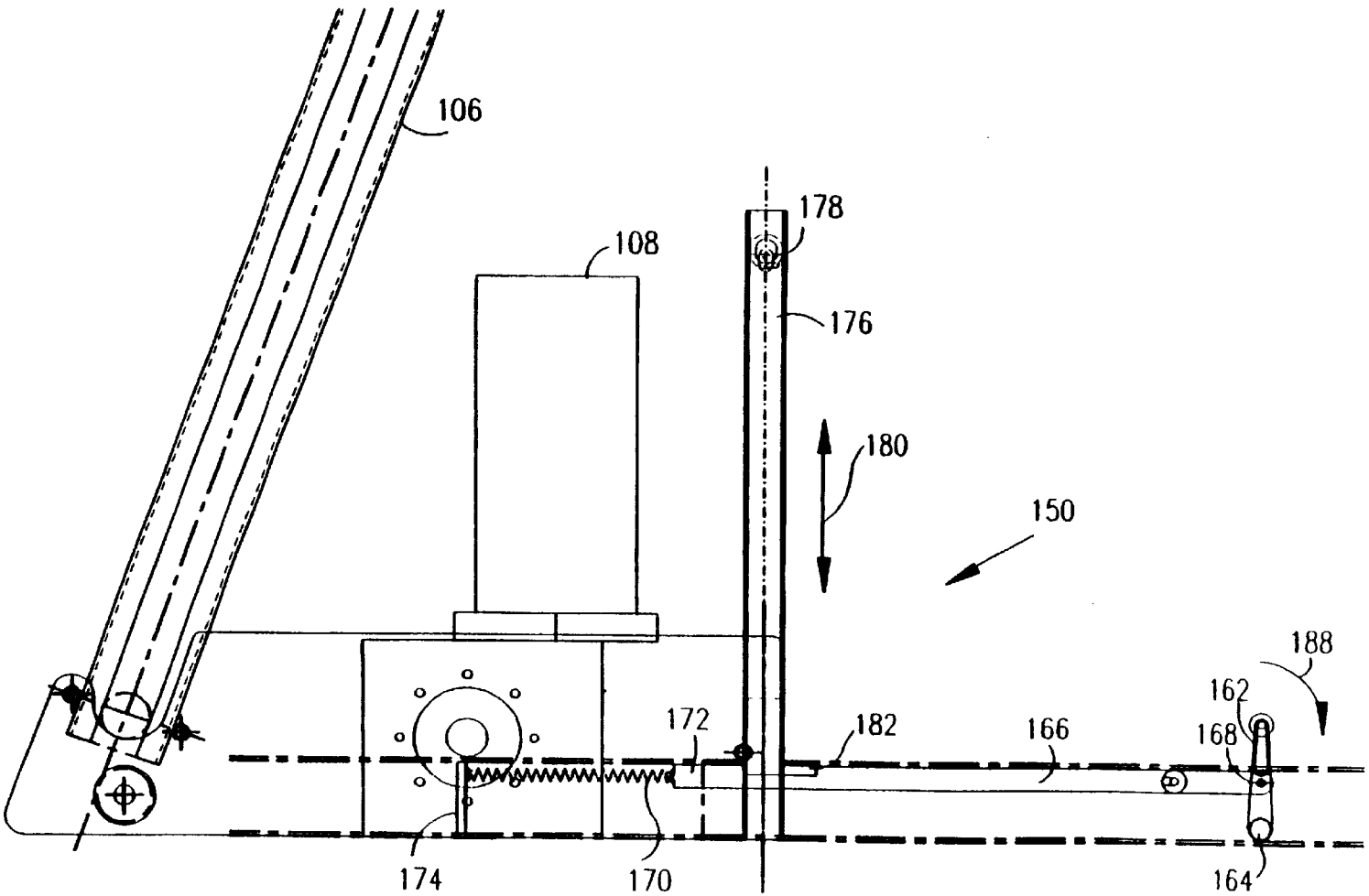
Figure 23:
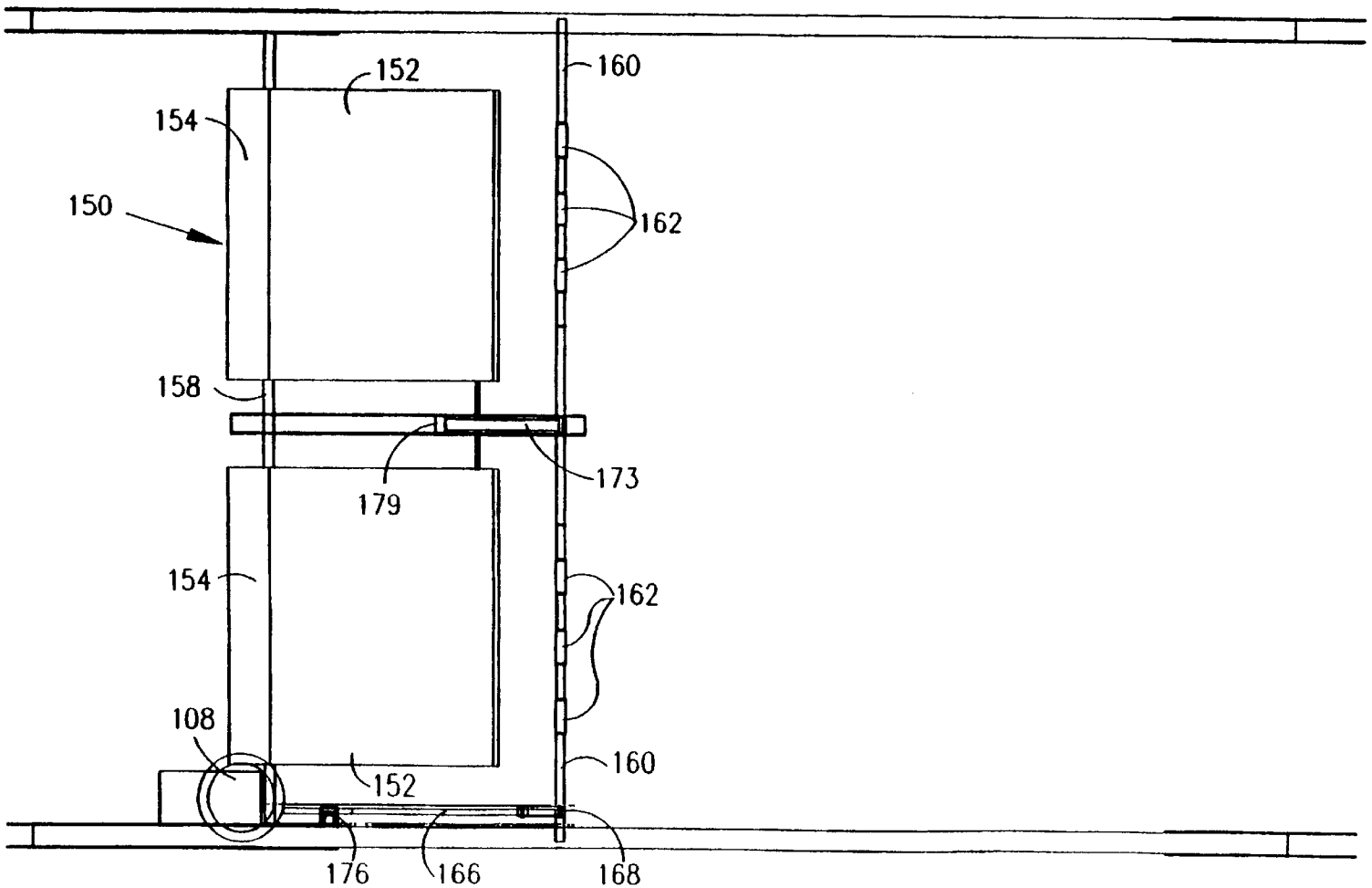

One or more pivotable wheel barriers 162 are provided, preferably positioned to the side of platforms 152, and mounted on a rod 160 (FIG. 23). Wheel barriers 162 are preferably pivoted at a lower end thereof about a pivot 164. A linkage arm 166 (FIG. 23) is preferably pivotally connected to rod 160 of wheel barriers 162 at one end 168 thereof and to a biasing device 170 (FIG. 22), such as a spring, at an opposite end 172 thereof. As seen in FIG. 22, biasing device 170 is preferably biased against and fixed to a bulkhead 174 fixed to frame 106 or any other stationary object. A locking bar 176 is preferably provided generally perpendicular to linkage arm 166. A lock 178 is preferably provided at one end of locking bar 176, wherein suitable rotation of a key (not shown) inserted in lock 178 permits movement of locking bar 176 generally along a vertical axis 180. Linkage arm 166 is preferably formed with a recess 182 which is adapted to received therein locking bar 176.

Locking mechanism 150 also preferably includes a stop bar 173 (FIGS. 20, 21 and 23) pivotally attached to rod 160 of wheel barriers 162 at a pivot 175. A pin 177 connected to platforms 152 is disposed below stop bar 173. Stop bar 173 is adapted to abut against a stationary chock 179, as is described further hereinbelow.

Figure 20:
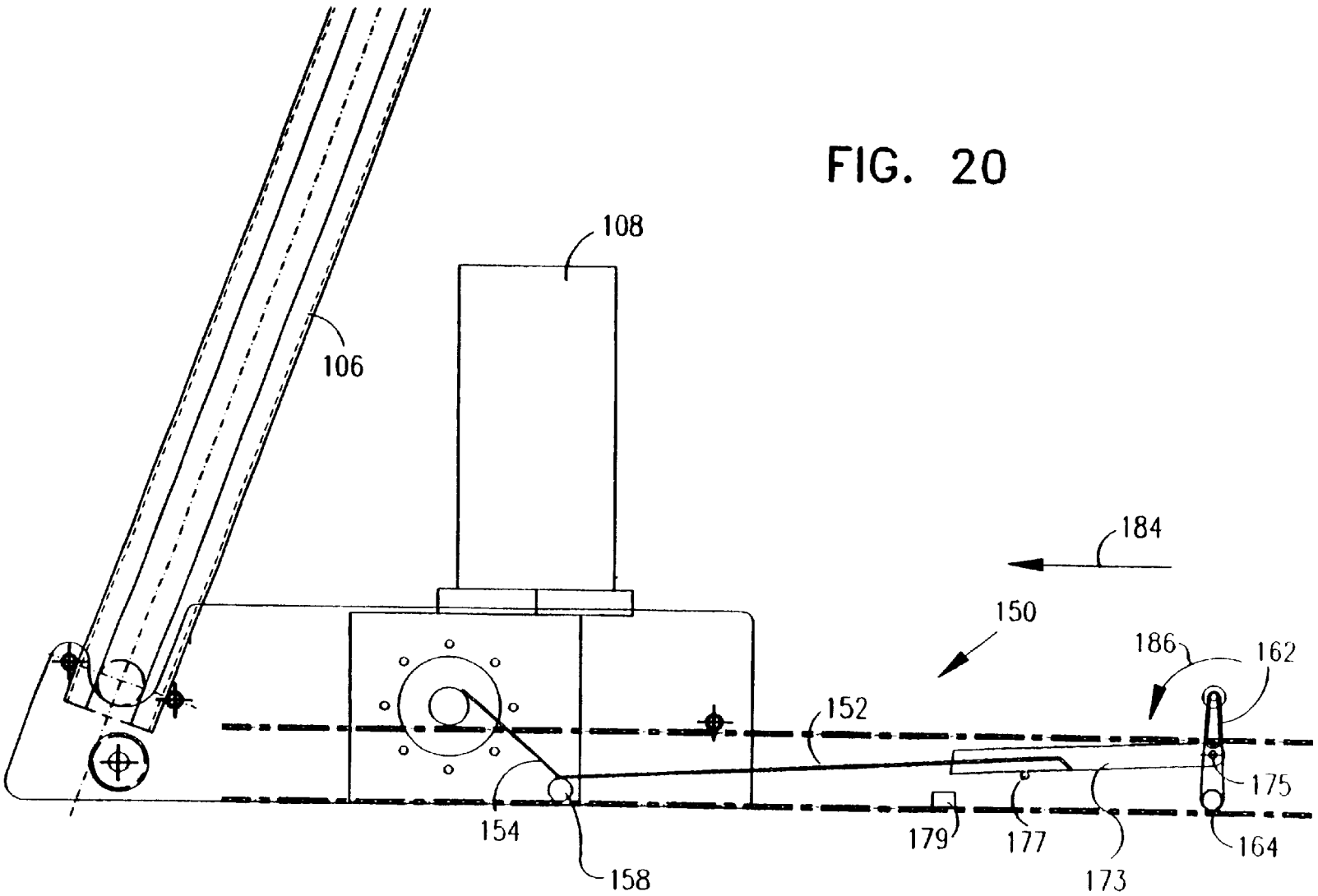

Operation of locking mechanism 150 will now be described. A vehicle entering the ground level of the parking system of the present invention travels in the direction of an arrow 184 (FIG. 20). In this direction, wheel barriers 162 do not prevent travel of tire 156, because the wheel barriers are free to pivot downwards in the direction of an arrow 186. The vehicle travels in the direction of arrow 184 until the tire 156 reaches the position shown in FIG. 21.

In FIG. 21, it is seen that the weight of the vehicle and tires 156 lower platform 152 and stop bar 173 freely pivots downward to abut against chock 179. In this orientation, stop bar 173 prevents wheel barriers 162 from pivoting downwards about pivot 164 in the direction of arrow 186. At the same time, locking bar 176 is engaged in and abuts against recess 182 as seen in FIG. 22, thereby preventing wheel barriers 162 from pivoting downwards about pivot 164 in the direction of arrow 188 opposite to arrow 186. Thus the vehicle cannot be stolen by moving in reverse in the direction of an arrow 190, opposite to arrow 184.

When the owner of the vehicle wishes to leave the parking space, lock 178 is opened to allow lifting locking bar upwards out of recess 182. Biasing device 170 urges linkage arm 166 slightly in the direction of arrow 190 so that locking bar 176 cannot fall back into recess 182. Now that locking bar 176 is not in recess 182, wheel barriers 162 can freely pivot downwards about pivot 164 in the direction of arrow 188 and the vehicle can be moved in reverse in the direction of arrow 190 to leave the parking space. Once the vehicle has left the parking space, the resilient platforms 152 deflect upward, thereby causing pin 177 to lift stop bar 173 away from chock 179.

When the vehicle is moved back into the parking space (the orientation shown in FIG. 21), the pivoting motion of wheel barriers 162 in the direction of arrow 186 allows locking bar 176 once again to lockingly engage recess 182.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A parking system comprising:

a plurality of lever arms serially and pivotally connected to each other from a nearest lever arm to a furthest lever arm, each said lever arm being movable from a first orientation to a second orientation, wherein an angle of each said lever arm relative to a ground surface is greater in the second orientation than in the first orientation, the nearest lever arm being connectable to a support structure for supporting thereupon a vehicle to be parked; and drive apparatus operatively connected to said lever arms and operative to sequentially lift each of said lever arms, starting with the furthest lever arm and ending with the nearest lever arm, from its first orientation to its second orientation.

2. The parking system according to claim 1 wherein at least one of said lever arms constantly contacts the ground surface before said drive apparatus lifts the next furthest lever arm from the first orientation to the second orientation.

3. The parking system according to claim 2 wherein the furthest ground-contacting lever arm of those lever arms which contact the ground surface is pivotably connected at a reference pivot to the nearest lever arm of those lever arms which have been lifted above the ground surface to the second orientation.

4. The parking system according to claim 3 further comprising:

a support frame; and a support structure for supporting thereupon a vehicle, said support structure being pivotally attached at a far end thereof to the nearest lever arm and at a near end thereof to said support frame, wherein said drive apparatus is connected to the near end of said support structure and is operative to move the near end of said support structure along said support frame.

5. The parking system according to claim 4 wherein a vehicle is supported on said support structure, and said drive apparatus lifts said lever arms such that the center of gravity of the vehicle is constantly positioned with respect to said reference pivot such that the total moment produced by the weight of the vehicle and the weight of the support structure on the far side of the reference pivot is not greater than the total moment produced by the weight of said support frame and said support structure acting on the near side of said reference pivot.

6. The parking system according to claim 4 wherein said drive apparatus comprises a motor which drives a chain drive connected to the near end of said support structure.

7. The parking system according to claim 4 wherein said support frame comprises generally arcuate support rails.

8. The parking system according to claim 4 wherein said support frame comprises support rails having a generally inverted U-shape with an elongate linear upper portion.

9. The parking system according to claim 6 wherein said chain drive is slidably supported on said support frame.

10. The parking system according to claim 9 wherein said support frame comprises an anti-friction material underlying said chain drive.

11. The parking system according to claim 6 wherein said chain drive comprises a bridging link pivotally connected to at least one of said lever arms.

12. The parking system according to claim 11 further comprising safety apparatus responsive to slackening of said chain drive, which locks the bridging link against the support frame.

13. The parking system according to claim 12 wherein said safety apparatus comprises a normally retracted, spring-loaded stop member, and a series of protrusions provided on the support frames, so that upon a slackening of said chain drive, free fall of the support frame is prevented by the stop member becoming engaged by a nearby protrusion.

14. The parking system according to claim 1 further comprising a turntable platform rotatably mounted on said lever arms.

15. The parking system according to claim 14 further comprising an actuator, operable by rotation of the turntable platform over said lever arms, for actuating flaps provided at a vehicle access position on the turntable platform.

16. The parking system according to claim 1 further comprising a locking mechanism for locking wheels of a vehicle parked on the ground surface.

17. The parking system according to claim 16 wherein said locking mechanism comprises:

at least one platform arranged to move downwards when bearing a wheel of a vehicle thereupon;

a pivotable wheel barrier pivoted at a lower end thereof about a pivot;

a stop bar pivotally attached to said wheel barrier, adapted to abut against a stationary chock, said stop bar being supported by a pin connected to said at least one platform, wherein when said at least one platform is moved downwards, said stop bar pivots and abuts against the chock.

18. The parking system according to claim 17 said locking mechanism further comprising:

a linkage arm pivotally connected to said wheel barrier at one end thereof and to a biasing device at an opposite end thereof, a locking bar arranged to move against said linkage arm and to be received in a recess formed in said linkage arm; and a lock mounted at one end of said locking bar which selectively permits movement of said locking bar.

19. The parking system according to claim 1 further comprising a sensor mounted in propinquity to said lever arms which senses and verifies an absence of a person within a predefined zone with respect to said lever arms.

20. A parking system comprising:

a support structure;

a vehicle supported on said support structure;

a plurality of lever arms serially and pivotally connected to each other from a nearest lever arm to a furthest lever arm, the furthest lever arm being connected to said support structure; and drive apparatus operatively connected to said lever arms and operative to sequentially lift each of said lever arms starting with the furthest lever arm and ending with the nearest lever arm, such that the center of gravity of said vehicle is constantly positioned with respect to a pivot connection between two of said lever arms such that the total moment produced by the weight of the vehicle and the weight of the support structure on the far side of the pivot connection is not greater than the total moment produced by the weight of the vehicle and the weight of the support structure on the near side of the pivot connection.

* * * * *

UNITED STATES PATENT AND TRADEMARK OFFICE

CERTIFICATE OF CORRECTION

PATENT NO. : 6,607,343 B1
DATED : August 19, 2003
INVENTOR(S) : Avraham Amgar

It is certified that error appears in the above-identified patent and that said Letters Patent is hereby corrected as shown below:

Column 4,
Line 51, please delete “C” and insert therefor -- C1 --.

Signed and Sealed this

Ninth Day of December, 2003

JAMES E. ROGAN
*Director of the United States Patent and Trademark Office*